US009133575B2

(12) United States Patent
Hong

(10) Patent No.: US 9,133,575 B2
(45) Date of Patent: Sep. 15, 2015

(54) WASHING MACHINE AND CONTROL METHOD THEREOF

(75) Inventor: Sangwook Hong, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 209 days.

(21) Appl. No.: 13/880,149

(22) PCT Filed: Sep. 30, 2011

(86) PCT No.: PCT/KR2011/007232

§ 371 (c)(1),
(2), (4) Date: Apr. 18, 2013

(87) PCT Pub. No.: WO2012/053751

PCT Pub. Date: Apr. 26, 2012

(65) Prior Publication Data

US 2013/0219741 A1 Aug. 29, 2013

(30) Foreign Application Priority Data

Oct. 19, 2010 (KR) ..... 10-2010-0101760

(51) Int. Cl.
*D06F 58/20* (2006.01)
*D06F 25/00* (2006.01)
(Continued)

(52) U.S. Cl.
CPC ..... *D06F 25/00* (2013.01); *D06F 33/02* (2013.01); *D06F 58/24* (2013.01); *D06F 58/28* (2013.01); *D06F 2058/2854* (2013.01); *D06F 2058/2896* (2013.01)

(58) Field of Classification Search
CPC ..... F26B 3/00; F26B 5/00; F26B 9/00; F26B 21/00; F26B 21/10; D06F 58/00; D06F 58/02; D06F 58/10; D06F 58/20; D06F 58/206; D06F 58/24
USPC ..... 34/381, 595, 601, 610; 58/5 C, 19, 20
See application file for complete search history.

(56) References Cited

U.S. PATENT DOCUMENTS 7,448,146 B2 * 11/2008 Cho et al. ..... 34/601
2003/0089138 A1 * 5/2003 Kawamura et al. ..... 68/17 R
(Continued)

FOREIGN PATENT DOCUMENTS

CN 1490454 A 4/2004
CN 1724796 A 1/2006
(Continued)

OTHER PUBLICATIONS
International Search Report issued in PCT Application No. PCT/KR2011/007232 dated Jan. 23, 2012.
(Continued)

*Primary Examiner* — Stephen M Gravini
(74) *Attorney, Agent, or Firm* — KED & Associates, LLP

(57) ABSTRACT

A washing machine and a control method therefore are disclosed. The washing machine includes a cabinet (10); a tub (100) fixed to the cabinet (10); a drum (300) rotatably provided in the tub (100); a dry duct (20) which heats air exhausted from the tub (100) a predetermined temperature, to re-supply the heated air to the tub (100); condensation unit (170) which condenses moisture on at least a predetermined area of an inner circumferential surface of the tub (100) by heat-exchanging external air of the cabinet (10) with at least predetermined area of an outer circumferential surface of the tub (100); and sensing unit (410) which senses the amount of condensate generated in the tub (100). A washing machine and a control method thereof are disclosed. The washing machine includes a cabinet; a tub fixed to the cabinet; a drum rotatably provided in the tub; a dry duct which heats air exhausted from the tub a predetermined temperature, to re-supply the heated air to the tub; condensation unit which condenses moisture on at least a predetermined area of an inner circumferential surface of the tub by heat-exchanging external air of the cabinet with at least predetermined area of an outer circumferential surface of the tub; and sensing unit which sense the amount of condensate generated in the tub.

18 Claims, 12 Drawing Sheets

(51) Int. Cl.

| | |
|---|---|
| ***D06F 33/02*** | (2006.01) |
| ***D06F 58/24*** | (2006.01) |
| ***D06F 58/28*** | (2006.01) |

(56) References Cited

U.S. PATENT DOCUMENTS

| | | | | |
|---|---|---|---|---|
| 2010/0192639 | A1* | 8/2010 | Kim et al. | 68/20 |
| 2011/0289796 | A1* | 12/2011 | Ha et al. | 34/468 |
| 2013/0219741 | A1* | 8/2013 | Hong | 34/486 |

FOREIGN PATENT DOCUMENTS

| | | | | | |
|---|---|---|---|---|---|
| CN | 1844548 | A | | 10/2006 | |
| EP | 1 108 811 | | | 6/2001 | |
| EP | 2290154 | A2 | * | 3/2011 | |
| EP | 2292826 | A1 | * | 3/2011 | |
| GB | 710054 | | * | 6/1954 | |
| GB | 2323151 | A | * | 9/1998 | D06F 58/08 |
| JP | H08-033796 | A | | 2/1996 | |
| JP | S61-098298 | A | | 5/1996 | |
| JP | 2006289049 | A | * | 10/2006 | |
| JP | 2011206611 | A | * | 10/2011 | |
| KR | 1996-0013395 | | | 10/1996 | |
| KR | 10-2005-0018037 | A | | 2/2005 | |
| WO | WO 2009/106926 | | | 9/2009 | |
| WO | WO 2010137910 | A2 | * | 12/2010 | |

OTHER PUBLICATIONS

Chinese Office Action dated Dec. 31, 2014 issued in Application No. 201180054533.2 (English translation and Full Chinese Text).

* cited by examiner

Fig. 8
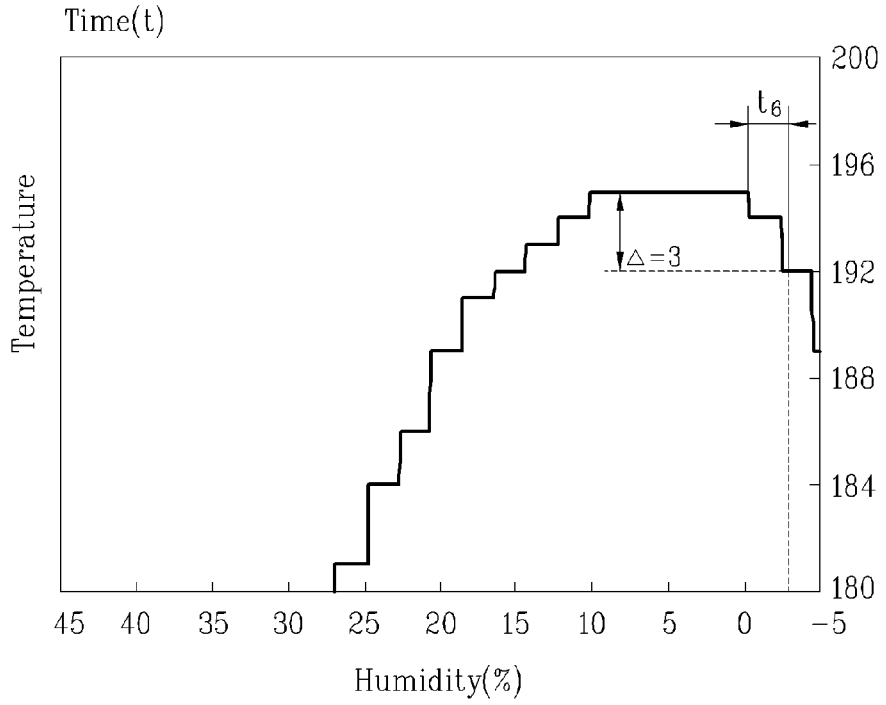
[Fig. 9]
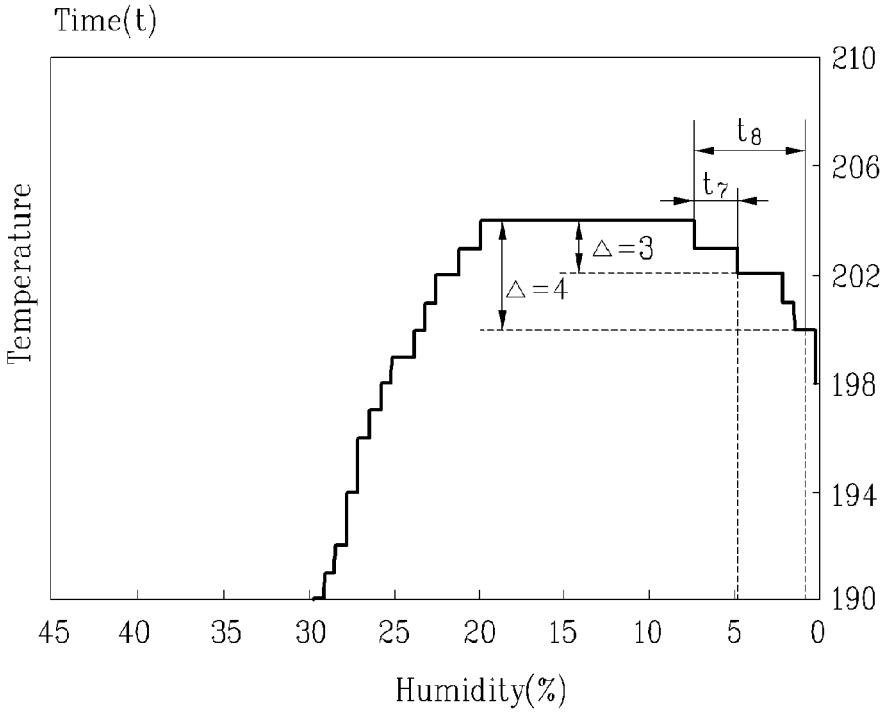

WASHING MACHINE AND CONTROL METHOD THEREOF

CROSS-REFERENCE TO RELATED PATENT APPLICATIONS

This application is a U.S. National Stage Application under 35 U.S.C. §371 of PCT Application No. PCT/KR2011/007232, filed Sep. 30, 2011, which claims priority to Korean Patent Application No. 10-2010-0101760, filed Oct. 19, 2010.

TECHNICAL FIELD

The present invention relates to a washing machine and a control method thereof.

BACKGROUND ART

Generally, a washing machine is an electric appliance which is able to remove various contaminants attached to clothes, beddings and wearable items (hereinafter, laundry) by using emulsion action of detergent, friction of water currents generated by rotation of a pulsator or drum and shock applied to laundry. A full-automatic washing machine which is introduced recently performs a series of cycles including washing, rinsing and dry-spinning courses automatically, without a manual operation.

In recent, demands for drum type washing machines have been increasing gradually, because drum type washing machines can reduce an overall height and generate no problems of wrinkles and tangle generated in laundry, compared with pulsator type washing machines.

To put a structure of the drum type washing machine mentioned above simply, the drum type washing machine includes a cabinet which defines an exterior appearance thereof, a tub located in the cabinet, with being supported by a damper and a spring, to receive wash water therein, and a cylindrically-oriented drum located in the tub to receive laundry therein. A driving force is transferred to the drum is by a driving part to wash the laundry loaded into the drum.

Such the drum type washing machine having the structure mentioned above generates vibration because of a rotational force of the drum generated when it is rotated and eccentricity of the laundry as an inevitable consequence. The vibration generated by the rotation of the drum is transferred outside via the tub and the cabinet.

Because of that, it is necessary to provide the spring and the damper provided between the tub and the cabinet to suspend and dampen the vibration of the tub and to prevent the vibration transferred to the tub from the drum from transferred to the cabinet.

In the meanwhile, the drum type washing machine mentioned above is installed in an existing installation environment (for example, a sink environment or a built-in environment), not installed separately. As a result, the dimension of the drum type washing machine has to be limited by an installation environment.

It is limited to change an internal structure of such the drum type washing machine for the structure of the spring and damper provided between the tub and the cabinet to suspend and dampen the vibration, as mentioned above. Also, it is limited to change the dimension of the washing machine, because the installation environment of the drum type washing machine is limited.

A lot of searches and developments have been in progress about increase of a washing capacity of the washing machine to improve the amount of washing objects and users convenience recently. However, it is quite difficult in the structure of the conventional drum type washing machine to improve the dimension of the tub to improve the washing capacity, because of the limited conditions mentioned above.

In the meanwhile, the washing machine may be classified into a washing-only device with only a washing function and a washing machine with a drying function.

The washing machine having the drying function may be classified based on the structure or type into a drum type drying machine capable of drying laundry through rotating and tumbling of the laundry performed by a rotatable drum and a cabinet type drying machine capable of drying the laundry that is hung therein.

The drum type washing machine having the drying function may include a cabinet which defines an exterior appearance thereof, a tub mounted in the cabinet and a drum rotatably mounted in the tub.

In addition, a dry duck where dry air is circulated, a heater and a ventilation fan which are installed in the dry duck and a condensation duct where damp air used in drying is circulated and condensed may be provided outside the tub. Auxiliary air-cooled or water-cooled type condensation means used for condensation may be provided in the condensation duct.

Hot air is supplied to the laundry in the conventional washing machine by control of a heater, in other words, by On/Off of a heater. However, the heater control may control On/Off of the heater in reference to the temperature of the heater or the temperature near the heater. Because of that, the conventional washing machine has a problem of failure in preventing the overheating which might be generated at a specific spot on an entire passage where air is circulated.

More specifically, the hot water which is heated after dehumidified may be supplied between the heater and the drum, and heat exchange may be performed in the drum or the tub. After that, the hot air heat-exchanged after dehumidified may be drawn into the heater again. As a result, the possibility of the overheating generated on the heated-air passage between the heater and the drum can be growing disadvantageously. This is because it can be said that there is no object of efficient heat transfer such as a water element on such the passage. Especially, as the heated-air is constantly supplied in an initial stage of the heated-air supply, the possibility of the overheating on the heated-air passage between the heater and the drum seems to be growing more.

Such the overheating may generate heat distortion or damage of elements. Because of that, there may be a concern of deteriorated stability and reliability of the washing machine.

In addition, the washing machine having the drying function according to the prior art determines a timing of determining whether drying of laundry is complete by using a temperature sensor provided in the dry duct. That is, the temperature of the heated-air collected after drying the laundry is measured repeatedly, to determine an end timing of the drying.

However, it is impossible to precisely sense the end timing of the drying by using the temperature of the heated-air. Because of that, the drying is performed for a less time period that fails to reach the end timing of the drying and the laundry happens to be not dried sufficiently. Or, the drying is performed for a more time period that passes the end timing of the drying and the laundry happens to damage accordingly.

To determine the end timing of the drying, the drying time is set sweepingly by sensing the amount or humidity of the laundry simply. Once the set drying time passes, the drying is set to stop. However, the drying end timing of the drying of the laundry performed according to the operation of such the drying module may be set different based on a type of the laundry and a relative humidity. As a result, an actual drying end time may be different from the preset drying time.

Therefore, the conventional washing machine having the drying function may have a problem of incomplete laundry drying because of external condition change. In this case, the user has to operate additional drying of the laundry inconveniently. Also, it has a problem of too much drying performed for the laundry because of external condition change. In this case, damage to the laundry might be generated by too much heated-air. As a result, it is required to sense the precise drying end timing.

DISCLOSURE OF INVENTION

Technical Problem

To solve the problems, an object of the present invention is to provide a washing machine having a drying function which can increase the capacity of a tub in a state of maintaining an exterior size applied to a conventional washing machine and which can improve a supporting structure capable of supporting the capacity-increased tub effectively.

Another object of the present invention is to provide a washing machine which can prevent overheating by controlling the temperature of heated-air effectively, to enhance stability and reliability.

A further object of the present invention is to provide a washing machine which can reduce increase of a heated-air drying time as much as possible by controlling a heater effectively, to enhance stability and user convenience.

A still further object of the present invention is to provide a washing machine which has security by preventing breakage of an overheated door glass located in a front part of a drum.

A still further object of the present invention is to provide a washing machine which can perform natural cooling type condensation without using auxiliary forced cooling means. In other words, an auxiliary configuration for cooling water supply or cold air supply may not be provided to condense the moisture contained in air and the washing machine according to the present invention has a simple configuration. Alternatively, in case of performing the forced cooling type condensation, the present invention may provide a washing machine having an improved condensation rate.

To solve the problems, the present invention provides a method of determining a drying completion point which can determine drying of laundry by sensing a surface temperature of a tub while drying of the laundry is performed, and a drying method using the same.

Furthermore, to solve the problems, the present invention provides a method of determining drying completion of a washing machine having a drying function which can condense dry air having dried laundry on an inner wall of a tub by using air and which can determine a drying completion point of the laundry by using the amount of condensate generated on the inner wall of the tub.

Solution to Problem

To achieve these objects and other advantages and in accordance with the purpose of the invention, as embodied and broadly described herein, a washing machine includes a cabinet; a tub fixed to the cabinet; a drum rotatably provided in the tub; a dry duct which heats air exhausted from the tub a predetermined temperature, to re-supply the heated air to the tub; condensation means which condenses moisture on at least a predetermined area of an inner circumferential surface of the tub by heat-exchanging external air of the cabinet with at least predetermined area of an outer circumferential surface of the tub; and sensing means which sense the amount of condensate generated in the tub.

In another aspect of the present invention, a control method of a washing machine including a heater which heats air and a fan which supplies air to the tub, the control method includes steps of: sensing the first amount of laundry; sensing the second amount of the laundry; calculating the expected amount of condensate based on the sensed first and second quantities of the laundry; sensing the amount of condensate generated while drying of the laundry is performed; and determining a point of drying completion by comparing the sensed amount of the condensate and the expected amount of the condensate.

In a further aspect of the present invention, a control method of a washing machine includes steps of: sensing condensate generated while drying of laundry is performed; sensing a decreasing rate of the sensed amount of the condensate; and completing the drying, when the decreasing rate of the amount of the condensate is equal to a preset value or less.

Advantageous Effects of Invention

The present invention has following advantageous effects. According to the present invention, there may be an effect of increasing the capacity of a tub in a state of maintaining an exterior size applied to a conventional washing machine and of improving a supporting structure capable of supporting the capacity-increased tub effectively.

Furthermore, the present invention may provide a washing machine which can prevent overheating by controlling the temperature of heated-air effectively, to enhance stability and reliability.

A still further, the present invention may provide a washing machine which can reduce increase of a heated-air drying time as much as possible by controlling a heater effectively, to enhance stability and user convenience.

A still further, the present invention may provide a washing machine which has security by preventing breakage of an overheated door glass located in a front part of a drum.

A still further, the present invention may provide a washing machine which can perform natural cooling type condensation without using auxiliary forced cooling means. In other words, an auxiliary configuration for cooling water supply or cold air supply may not be provided to condense the moisture contained in air and the washing machine according to the present invention has a simple configuration. Alternatively, in case of performing the forced cooling type condensation, the present invention may provide a washing machine having an improved condensation rate.

A still further, there may be an effect of reduced maintenance of less water usage, because air having dried laundry is condensed by heat-exchanging performed between sucked external air with a circumferential surface of a tub.

A still further, there may be an effect of determining a drying completion point precisely by using the amount of condensate generated on an inner wall of the tub.

A still further, according to a method of determining a drying completion point of a washing machine and a drying method using the same, there may be an effect of determining drying of laundry by sensing a surface temperature of a tub while drying of the laundry is performed.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

FIGS. 8 to 10 are graphs illustrating change of a tub surface temperature according to various quantities of laundry;

BEST MODE FOR CARRYING OUT THE INVENTION

As follows, embodiments of the present invention will be described in detail in reference to the accompanying drawings.

The present invention relates to a washing machine having a drying function and it is not limited to a specific type washing machine. The present invention is not limited to a drum type dryer or a drum type washing machine having a drying function, which will be described later.

Figure 1:
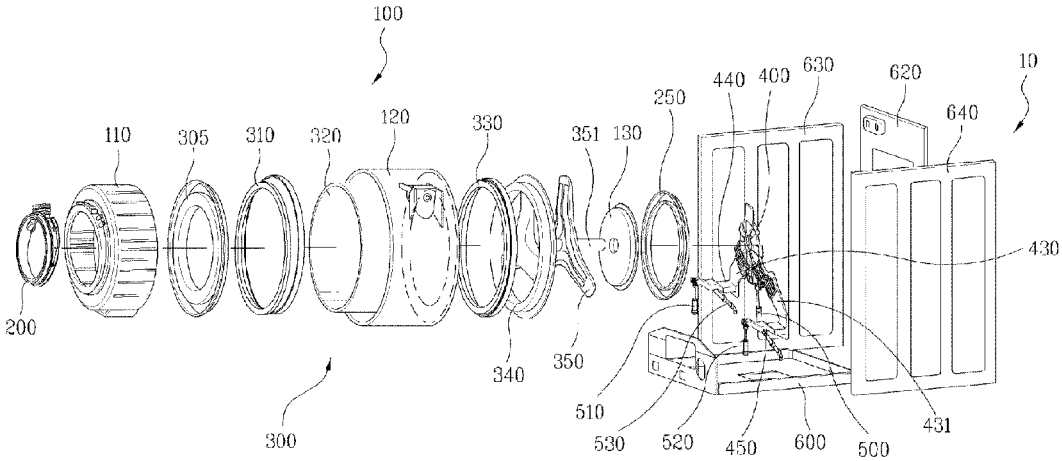
FIG. 1 is an exploded perspective view illustrating a washing machine according to an embodiment.

FIG. 1 illustrates a washing machine according to an embodiment. The washing machine shown in FIG. 1 is a washing machine having a drying function. This embodiment represents that a condensation part provided in the washing machine according to this embodiment is a tub.

The washing machine according to the present invention may include a tub 100 that is fixedly supported by a cabinet 10. The tub 100 may include a tub front 110 defining a front part thereof and a tub rear 120 defining a rear part thereof.

The tub front 110 and the tub rear 120 may be assembled by a screw, to form a predetermined room where a drum is received. The tub rear may include an opening formed in a rear portion thereof. The opening of the tub rear 120 is connected with a rear gasket 250 that is a flexible member and a radial direction inner portion of the rear gasket 250 may be connected to a tub back 130. A through hole is formed in a center of the tub back 130 and a shaft passes through the through hole. The rear gasket 250 may be flexible enough to prevent vibration of the tub back 130 from being transferred to the tub rear 120.

The rear gasket 250 is sealed to be connected with the tub back 130 and the tub rear 120, to prevent wash water inside the tub from leaking. The tub back 130 is vibrated together with the drum when the drum is rotated. The tub back 130 is spaced apart a proper distance from the tub rear 120, not to interfere with the tub rear 120. Since it is transformed flexibly, the rear gasket 250 allows to the tub back 130 to more relatively without interfering with the tub rear 120. The rear gasket 250 may include a curvature part or a corrugation part which is extendible by an enough length to allow the relative movement of the tub back 130.

The tub has a laundry introduction opening formed in a front part thereof to introduce laundry into the washing machine. A front gasket 200 may be installed in the front part of the tub where the laundry introduction opening is formed, for preventing the laundry from being discharged via the opening or preventing the laundry or foreign matters from being drawn into a gap between the tub and the drum or for another function.

The drum 300 may include a drum front 305, a drum center 320 and a drum back 340. Balancers 310 and 330 may be installed in front and rear parts of the drum, respectively. The drum back 340 may be connected with a spider 350 and the spider 350 may be connected with a shaft 351. The drum may be rotated within the tub by a rotational force transmitted via the shaft 351.

The shaft 351 may be connected with a motor, passing through the tub back 130. According to this embodiment, the motor may be connected with the shaft concentrically. In other words, the motor is directly connected with the shaft according to this embodiment. Specifically, a rotor of the motor is directly connected with the shaft 351. A bearing housing 400 is coupled to a rear surface of the tub back 130. The bearing housing 400 may support the shaft 351 rotatably, with being located between the motor and the tub back 130.

A stator (not shown) of the motor is fixedly installed to the bearing housing 400. The rotor (not shown) is located around the stator. As mentioned above, the rotor is directly connected with the shaft 351. The rotor is an outer rotor type motor and it is directly connected with the shaft 351.

The bearing housing 400 is supported by a suspension unit with respect to a cabinet base 600. The suspension unit may include a plurality of brackets connected with the bearing housing. The plurality of the brackets may include radial direction brackets 430 and 431 extended along a radial direction and shaft direction brackets 440 and 450 extended along a drum shaft direction, with being connected with the bearing housing.

The suspension unit may include a plurality of suspensions connected with the plurality of the brackets.

In this embodiment, the suspensions may include three perpendicular suspensions 500, 510 and 520 and two slope suspensions 530 and 540 installed obliquely with respect to a forward and rearward direction. The suspension unit is flexibly connected with the cabinet base 600 to allow the drum to move in forward/rearward and rightward/leftward directions, not connected with the cabinet base 600 fixedly. In other words, the suspension unit is supported flexibly to allow the drum to rotate along forward/rearward and rightward/leftward directions with respect to the connected points with the cabinet base. For the flexible support, the perpendicular suspensions may be installed to the cabinet base 600 via rubber bushing. The perpendicular suspensions may be configured to suspend the vibration of the drum elastically and the slope suspensions may be configured to dampen the vibration. In other words, the perpendicular suspensions may be employed as a spring and the slope suspensions may be employed as damping means in a vibration system including a spring and damping means.

The tub is fixedly mounted in the cabinet and the vibration of the drum is suspended by the suspension unit. Front and rear surfaces of the tub may be fixed to the cabinet and the tub may be supportedly seated on the cabinet base, more specifically, fixed to the cabinet base.

Substantially, the structure of the tub and the drum may be separate in the washing machine according to this embodiment. It can be said that the washing machine according to this embodiment has the structure that the tub may not be vibrated structurally, even when the drum is vibrated. Here, the amount of the vibration of the drum transferred to the tub may be variable according to the rear gasket.

The vibration of the tub is remarkably small in the washing machine according to this embodiment. Because of that, the washing machine according to this embodiment needs not a gap maintained for the vibration in the conventional washing machine and an outer surface of the tub may be located closest to the cabinet as possible accordingly. This makes it possible to enlarge the size of the tub and to improve the capacity of the washing machine, with the same external size.

Substantially, the gap between the tub and a right cabinet 630 or a left cabinet 640 is no more than 5 mm. in the conventional washing machine having the tub vibrated together with the drum, the gap between the tub and the cabinet is 30 mm to make the vibration of the tub not interfere with the cabinet. Considering a diameter of the tub, a diameter of the tub according to this embodiment may be enlarged by 50 mm, compared with the diameter of the conventional tub. This results in a remarkable difference which enables the capacity of the washing machine to increase up to a higher level, with the same exterior size.

Although not shown in the drawings, the washing machine may include a water supply valve connected with a commercial water supply to supply wash water to the tub. Also, a detergent box may be installed in the washing machine.

The water supply valve may be connected with the detergent box via a hose. The detergent box may be connected with the tub via a hose. Because of that, when washing is performed, the water supply valve is turned on to supply water to the tub via the detergent box from the commercial water supply.

In the meanwhile, according to this embodiment, all of the heated-air discharged from the dry duct may be substantially supplied to the inside of the drum. This is because the heated-air directly drawn into a space between the tub and the drum has concern of disturbing natural condensation which will be described later. As a result, a heated-air inlet hole 25 may be provided to supply the heated-air toward the inside of the drum from a front portion of the drum 300.

The heated-air inlet hole 25 may be provided through the front gasket 200. Here, the gasket is an element configured to prevent the wash water from leaking outside the tub via the front opening of the drum. As a result, the heated-air inlet hole 25 may be located in front of the front opening of the drum 300. The heated-air inlet hole 25 may be provided to lead out the heated-air perpendicularly to supply all of the discharged heated-air to the inside of the drum substantially.

The dry duct 20 may include a connection duct 27 inserted in the heated-air inlet hole 25 and a scroll 23 connected with a heated-air outlet hole 51 formed in the tub 100. Here, the scroll 23 may have a fan 22 located therein and a heater 21 may be installed between the connection duct 27 and the scroll 23.

In the meanwhile, the front gasket 200 coupled to a front portion of the tub front 110 may have a duct connection part 26 formed therein to be inserted in the heated-air inlet hole 25, such that the connection duct 27 and the heated-air inlet hole 25 may be sealed. The connection duct 27 may be inserted in the duct connection part 26 of the front gasket 200. The connection duct 27 may be fitted to the dry duct 20 having the heater installed therein in a upward direction and it may be snug-fitted to the heated-air inlet hole 25 in a downward direction, with the duct connection part 26 of the front gasket located there between.

In the majority of cases, a door configured to open and close the front opening of the drum may include a door glass (not shown). The door glass is formed of glass or reinforced plastic to enable a user to see the inside of the drum there through from the outside of the drum. Typically, such the door glass may be projected toward the inside of the drum to perform a function of preventing the laundry from moving to the front opening of the drum. The door and the door glass are well known knowledge and detailed description thereof will be omitted accordingly.

According to this embodiment, a top portion of the door glass may be slope downward to guide the heated-air discharged from the heated-air inlet hole 25 perpendicularly toward the drum inside. The location of the such the heated-air inlet hole 25 and the appearance of the door glass may enable all of the substantially discharged heated-air to be guided toward the drum inside. When the door is closed, a predetermined portion of the door glass is located inner to the drum inside than the front gasket 200.

Such the shape of the drum inlet passage and the structural characteristic may improve drying efficiency more. However, overheat might be generated in the drum inlet passage. Especially, overheat of the door glass might be a problem. To solve this problem, heater control is required and this will be described later.

Figure 2:
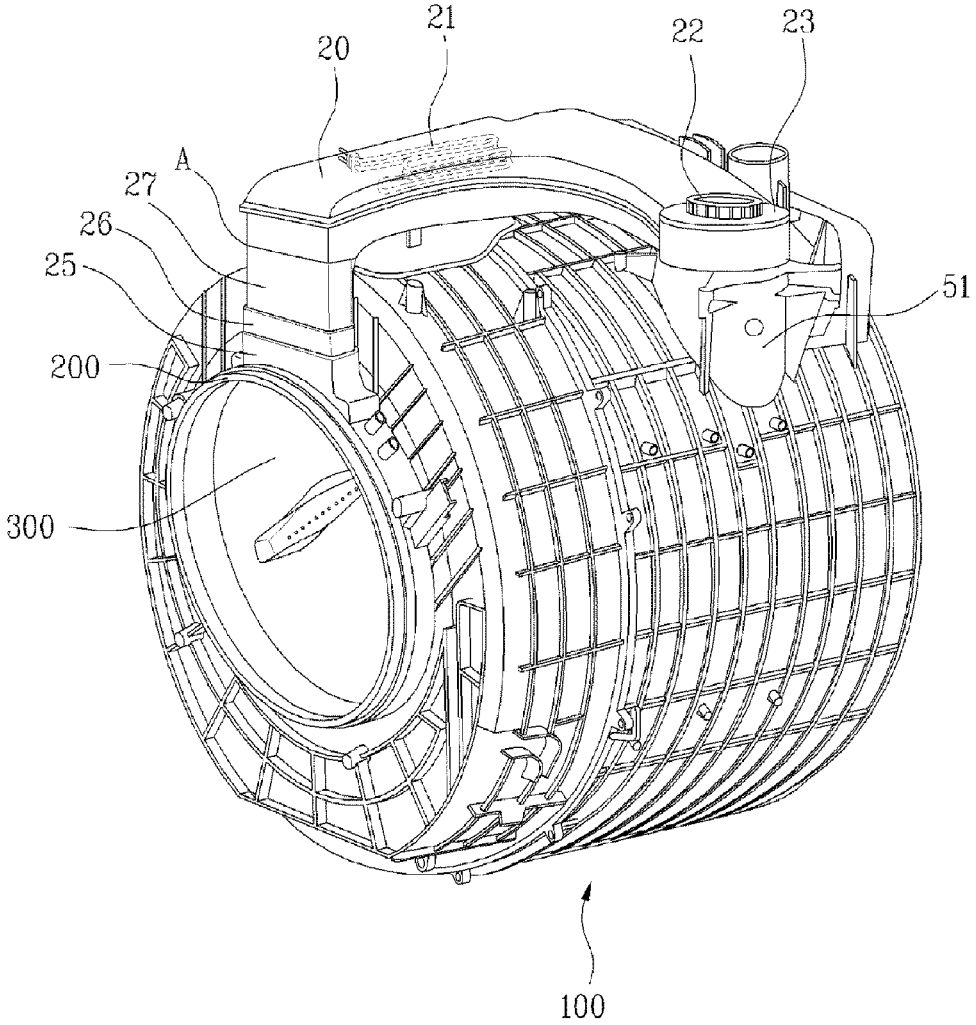
FIG. 2 is a perspective view illustrating a tub, a drum and a dry duct provided in the washing machine shown in FIG. 1.

FIG. 2 illustrates an inner structure of the washing machine. As shown in FIG. 2, the washing machine includes the dry duct 20 having the heater 21 provided therein and the drum 300 configured to perform drying of the laundry by the heated-air drawn from the dry duct 20.

This embodiment may further include the tub 100 configured to perform washing.

In the meanwhile, a controller (30, see FIG. 3) may be provided to control the temperature of the heated-air or the temperature of the heater. The controller may be provided to control the operation of each element composing the washing machine.

More specifically, the controller may be provided to control On/Off of the heater. For the control of the heater, a temperature sensor (23, see FIG. 3) may be provided to sense the temperature of the heater. The temperature sensor may sense the temperature of the heater 21 or the temperature near the heater and the temperature sensed by the temperature sensor may be referenced to as "sensed temperature".

The controller may control the heater 21 to be on to start heated-air drying and it may control the heater 21 based on the temperature sensed by the temperature sensor (the sensed temperature). In other words, the controller may control On/Off of the heater based on the sensed temperature.

The controller may vary an upper limit temperature at which the heater is off and it may raise the upper limit temperature gradually.

As shown in FIG. 2, this embodiment may omit the condensation duct, different from the conventional drying machine. In other words, the predetermined space between the tub 100 and the drum 300 may be utilized as condensation space, which will be described as follows.

The washing machine shown in FIGS. 1 and 2 may increase the volume of the tub and the volume of the drum more, with the same size of the cabinet, compared with the conventional washing machine. As a result, a surface area of the tub may be enlarged and natural cooling of the heated-air may be performed satisfactorily. In this case, most humidity of the heated-air supplied to the drum inside may be evaporated in the drum inside and heat of the heated-air may be emitted to the surface of the tub from the space between the drum and the tub to perform condensation. The heated-air of which the heat is condensed may be exhausted via the heated-air outlet hole 51 shown in FIG. 2 and such the heated-air may be re-drawn into the dry duct 20. Here, such air circulation may be performed by the operation of the fan 22.

For the natural condensation, it is possible to increase the rotation number of the fan 22 more than that of the fan in the conventional washing machine having the same standard. In other words, the air amount or velocity may be increased more. If the capacity of the heater is the same, the increasing of the air amount or velocity means increasing of heat exchange area per unit time. It is the same principle that laundry dries faster with much wind in warm weather than with less wind. As a result, the heat suction and the heat exhaustion may be performed much faster in the overall system.

The increasing of the air amount or velocity may be enabled by omitting of the condensation duct. It is limited by passage resistance of the condensation duct to increase the air amount or velocity. It is possible to omit the condensation duct and to draw the heated-air into the dry duct directly from the tub. Because of that, it is possible to increase the air amount or velocity by using the fan. In this case, it is preferable that a sectional area of the heated-air outlet hole 51 is larger in this embodiment than in the case using the condensation duct.

According to this embodiment, the washing machine may provide a drying part having a shaft connected with the drum, a bearing housing rotatably supporting the shaft and a motor rotating the shaft, and a suspension unit connected with the bearing housing to suspend vibration of the drum, as shown in FIG. 1.

In other words, different from the conventional washing machine, the suspension unit may not support the tub and it may suspend the vibration of the drum via the bearing housing directly. As a result, the vibration of the tub may be minimized only to increase the volume of the tub more. In other words, the tub may be supported more rigidly than the drum is supported by the suspension unit.

In addition, the washing machine according to this embodiment may include a flexible member configured to seal the rear portion of the tub to prevent water from leaking to the driving part from the tub, with allowing the driving part to be move by the tub relatively.

The natural condensation may be enabled in the space between the drum and the tub by the structural characteristic of the tub, the drum and the suspension unit.

Figure 3:
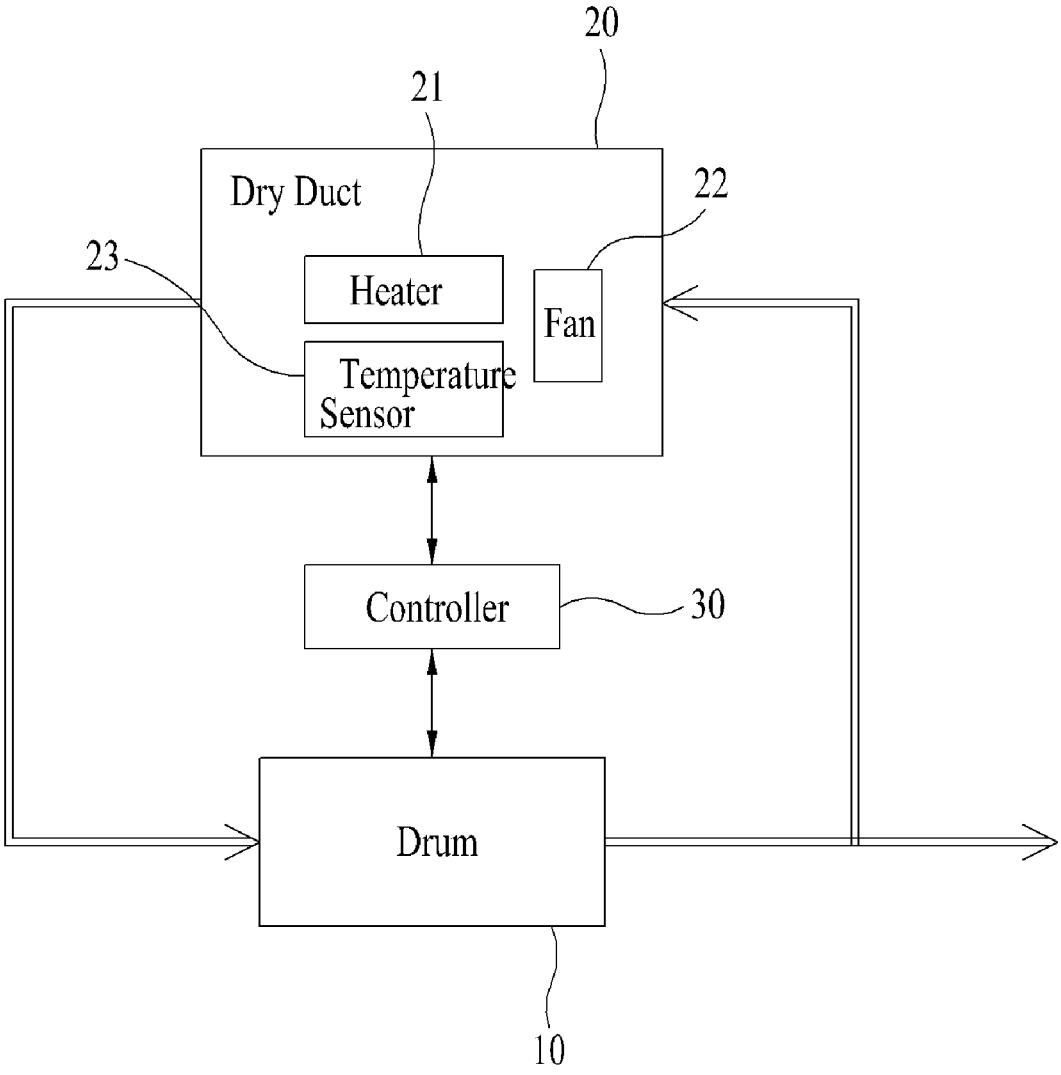
FIG. 3 is a block view schematically illustrating the structure of the washing machine shown in FIG. 1.

In the meanwhile, FIG. 3 is a diagram schematically illustrating the structure of the washing machine mentioned above.

In reference to FIG. 3, the heater 21 configured to heat air is provided for drying. The heater is not controlled to be on constantly while the drying is performed. This is because the heater has concern of overheating itself and another concern of a too high temperature of the heated-air heated by the heater. As a result, it is preferable that On/Off of the heater is controlled appropriately.

In a state of the heater being off, the temperature of air may be lowered. However, it is preferable that the temperature of air is high to perform the drying effectively. As a result, a period in which the heater is off may be set properly in consideration of overheating and cooling.

Considering the particulars mentioned above, On/Off of the heater may be controlled. In other words, it may be controlled repeatedly that the heater is off at a preset upper limit temperature and the heater is on at a preset lower limit temperature. As a result, the time period in which the heater is off may be controlled indirectly.

The overheating of the heater and the heated-air may be prevented by setting the preset upper limit temperature appropriately and the overcooling thereof may be prevented by setting the preset lower limit temperature appropriately. As a result, the drying time may be reduced very effectively.

To heat the air by using the heater, a fan 22 may be provided to generate air flow.

Also, a configuration for forming a predetermined space to accommodate the laundry may be provided and the laundry may be dried by the air heated by the heater in that space. The configuration forming such the space may be the drum 300.

The drum may be a drum provided in the conventional washing machine or a laundry accommodation part provided in the cabinet. In case of the conventional washing machine, a motor (not shown) configured to drive the drum may be provided and it may mean that the drum includes a laundry accommodation part provided in a cabinet type dryer.

A controller 30 may be provided to control the driving of the heater 21. Here, the controller 30 may drive or control the fan 22 mentioned above or the motor. In other words, the controller 30 may perform the control required to operate the washing machine.

A parameter used by the controller 30 to control the operation of the heater 21 may be variable and the parameter may include a temperature parameter. As a result, a temperature sensor 23 may be further provided to sense the temperature of the heater 21 or the temperature near the heater 21.

In addition, the air may be heated in a predetermined space, considering heat efficiency. As a result, a dry duct 20 may be provided to provide the space for heating the air. Here, inside the dry duct 20 may be provided the temperature sensor or the fan 22 mentioned above as well as the heater 21.

Drying objects, in other words, laundry having a moisture may be accommodated in the drum 300. Water is boiled at 100° C. in a normal state and the water absorbs a large amount of heat when a phase of the water is changed into a vapor (that is, evaporated). Because of that, it is difficult for the temperature inside the drum to be higher than 100° C. so far as a certain amount of water remains in the drum.

Of course, even if the temperature of the air inside the drum 300 does not reach 100° C., the evaporation may be performed and a large amount of heat may be absorbed at this time. The amount of the moisture evaporated at this time may be increased more as the temperature is increased.

The amount of the moisture evaporated in an initial drying of the drying, in other words, in an initial stage of a heated-air drying may be small and the heater is on constantly. Because of that, the temperature of the heated-air may be increased constantly and the temperature inside the drum may be increased also. However, when the temperature of the heated-air drawn into the drum is about 100° C., the temperature inside the drum is varied in a range between 50° C. and 75° C.

Here, On/Off of the heater may be controlled to increase the temperature inside the drum by using the heated-air appropriately to make the inside of the drum optimized for the drying. Here, the problem is that the temperature inside the drum can be controlled appropriately by the on/off of the heater but that overheating might be generated in other elements.

As shown in FIG. 3, the heated-air may be drawn into the drum from the dry duct 20. The heated-air heat-exchanged in the drum 300 may be re-drawn into the dry duct 20. This case may be called as circulation type drying which circulates air. In contrast, the heated-air heat-exchanged in the drum 300 may be exhausted outside the washing machine and this case may be called as exhaustion type drying. In the exhaustion type drying, external air is drawn into the dry duct 20.

In any types, the temperature of the air drawn into the dry duct 20 may be lower than the temperature of the air exhausted from the dry duct 20. Also, there is little possibility of the moisture remaining on the passage of the heated-air from the dry duct 20 to the drum (hereinafter, referenced to as "drum inlet passage"). As a result, the temperature of the air along the drum inlet passage might be increased too high, compared with the temperature of the air inside the drum. This might cause heat damage, heat distortion and breakage that are generated by the overheating of the elements. The high temperature might be transferred outside to cause the user s burn. Here, the damage caused by the overheat may be prevented to some extent by a heat resisting material or heat insulation material but this results in the increase of the product price and the complex structure.

Especially, such the overheating is likely to occur in the initial drying of the heated-air drying. This is because the initial drying is a period where the heater is on constantly to increase the temperature of the heated-air and the temperature inside the drum constantly.

In other words, the amount of the drawn heat is larger on the drum inlet passage than the amount of the transferred heat. As a result, the temperature on the drum inlet passage is increased more than the temperature of the heater 21 or near the heater 21 (hereinafter, referenced to as "sensed temperature") is increased. based on the result of the experiments performed by the inventor of the present invention, when the sensed temperature in the initial drying of the heated-air drying reaches a preset upper limit temperature, for example, 106° C., it is shown that the highest temperature on the drum inlet passage is increased up to 160° C. Here, there may be deviation in the sensed temperature according to the location of the temperature sensor, that is, which location of the temperature is sensed.

Such the too much temperature increase could play a big role in deteriorating durability of the elements located on the drum inlet passage. Especially, in case the door glass formed of glass is provided on such the drum inlet passage, the overheating might cause breakage of the door glass.

To solve the problem, the preset upper limit temperature may be changed not to be fixed during the entire drying process. In other words, the preset upper limit temperature may be changed gradually, considering the temperature of the heated-air and the drying time.

Here, a preset upper limit temperature in a period in which the drying is performed most actively is very important to perform the drying for an optimal time period. The period in which the drying is performed most actively means a period in which the evaporation of the moisture is generated most actively. Because of that, the largest heat absorption is generated in the period and the largest amount of the heat may be supplied to the inside of the drum.

As a result, if the entire process of the heated-air drying is divided into a plurality of periods, there may be an initial drying in which the temperature increase and the moisture evaporation inside the drum are expanded, an intermediate drying in which the moisture evaporation is generated most actively and a last drying in which the moisture evaporation is decreased gradually. As a result, the preset upper limit temperature mentioned above may be set to enable the optimal drying to be performed in the intermediate drying. Considering that, the preset upper limit temperature may be set to be 106° C. Here, the temperature may be corresponding to conventional drying performed to dry laundry that is heat-resistant such as cotton made clothes. Considering characteristics of the laundry that is the drying object, the temperature may be set relatively lower. The preset upper limit temperature may be a set temperature in the intermediate drying or a set temperature in the intermediate drying and the last drying. This is because the upper limit temperature might generate overheat in the initial drying.

In reference to FIG. 4, control of the heater in the heated-air drying process will be described in detail.

First of all, the heater is on initially and the heated-air drying starts. When the temperature reaches the preset upper limit temperature after that, the heater is off. Here, the preset upper limit temperature set to turn off the heater initially after the heated-air drying starts may be lower than the preset upper limit temperature set for the intermediate drying mentioned above. The former preset upper limit temperature may be referenced to as "T1" and the latter preset upper limit temperature may be referenced to as "T3". In other words, T1 may be preset lower than T3.

Once the heated-air drying is performed for a preset time period (t1) in a state of the heater being on, the heater is turned off. In other words, the temperature of the heated-air and the temperature inside the drum may be increased constantly until the preset time period (t1) passes. The time period (t1) may be variable based on the amount of the laundry or the amount of the moisture which will be dried. In other words, as the amount of the laundry and the amount of the moisture are getting increased, t1 is getting increased.

However, the drum inlet temperature may be prevented from increased too much by setting T1 lower than T3 as mentioned above, which will be described later.

In the meanwhile, the temperature at which the heater is turned on again after off is important as well as the temperature at which the heater is off. The temperature at which the heater is on again after off may be referenced to as "preset lower limit temperature." The preset lower limit temperature may be set appropriately, considering a sensing deviation of the temperature sensor in relation with the preset upper limit temperature, to prevent overcooling.

Such the preset lower limit temperature may be preset to be uniform constantly during the entire heated-air drying process. Here, it may be variable based on the preset upper limit temperature (T1 or T3). In the latter case, if the preset upper limit temperature is increased, the preset lower limit temperature may be increased.

First of all, when the heater is off after the temperature of the heated-air reaches T1, it is controlled for the temperature to reach the preset lower limit temperature the heater to turn on the heater again. After that, it may be controlled for the heater to be on/off repeatedly in a range between T1 and T3 for a preset time period (t2). T1 may be changed into T3, which may be called as "two step rise" and this is because T1 that is set one time is changed into T3 again. Also, T1 may be changed into T2 which is higher than T1 and T2 may be upwardly changed into t3 after a preset time period (t3) passes, which may be called as "three step rise."

Here, a preset lower limit temperature corresponding to T2 may be referenced to as "Tb" and a preset lower limit temperature corresponding to T3 may be referenced to as "Tc". Here, T2 may be higher than T1 and T3 may be higher than T2. In other words, the preset upper limit temperature may be set to be getting higher (rising) gradually. Also, the preset lower limit temperature may be set to be getting higher (rising) gradually.

In short, the heater may be controlled in a range between T1 and Ta for t2 as a first step. The heater may be controlled in a range between T2 and Tb for t3 as a second step. The heater may be controlled in a range of T3 and Tc for t4 as a third step.

The time period of t1 may be the initial drying and the time period in which the heater starts to be controlled at T3, that is, the time period before t1+t2+t3 may be the initial drying. The time period after that may be the intermediate drying.

As a result, the preset upper limit temperature may be rising via predetermined steps before the intermediate drying (t4) but T3 may not be changed after the intermediate drying. Of course, Tc may not be changed either. The T3 and Tc may not be changed until the heated-air drying ends.

In the meanwhile, as mentioned above, the time (t1) that is the time period until T1 is reached after the drying starts may not be fixed. In other words, the time (t1) may be changed based on the amount of the laundry or the amount of the moisture. Because of that, the time period at which T1 is set to rise up to T2 or T3 (t2 or t3) may be changed according to t1. For example, if t1 is 20 minutes, T1 may be set to rise after 10 minutes. If t1 is 26 minutes, T1 may be set to rise after 13 minutes. In other words, On/Off of the heater may be controlled by using T1 and Ta from t1 to t2. After t2, the On/Off of the heater may be controlled by using T2 and Tb. After t3, for example, if t1 is 20 minutes, t3 may be 10 minutes and if t1 is 26 minutes, t3 may be 13 minutes. The on and off of the heater may be controlled by using the T3 and Tc.

In other words, a rising point of T1 may be differentiated by t1. In case of multi-step rising, t2 and t3 may be set by the same rate to t1. If the rate is 0.5, the rate of t2 and t3 may be (t1)/2. If four step rising is performed, T1 may be set to rise after a time period of (t1)/3.

Also, a difference between T1 and Ta may not be changed. In other words, the difference between T2 and Tb may be identical to the difference between T3 and Tc. This is to prevent overcooling and errors that are generated by the deviation of the sensed temperatures sensed by the temperature sensor.

The heated-air drying described above may be a specific drying course. It may be a series of courses which are performed until the washing machine is stopped to operate after it starts to operate or it may be a specific cycle composing such a series of courses. In other words, the heated-air drying may be a cycle which finishes after on/off of the heater is controlled once the heater is turned on initially. Such a heated-air drying cycle is performed multiple times, to form a single drying course. As a result, once t4 passes, the heated-air drying may finishes as shown in FIG. 4. Only the fan may be driven for t5 and cold air may be supplied. As a result, the heated-air drying can mean the period from the time when the heater is turned on until the on/off of the heater performed based on the sensed temperature finishes, in a narrow sense.

As follows, the overheating prevention effect will be described in detail in reference to FIGS. 5 and 6.

Figure 5:
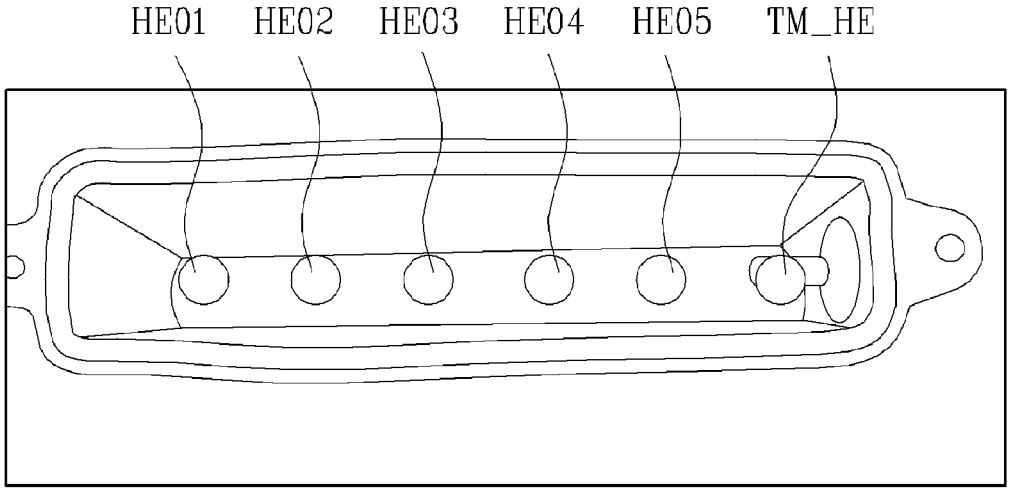
FIG. 5 is a sectional view of A shown in FIG. 2.

FIG. 5 is a sectional view of "A" shown in FIG. 2. In other words, a specific portion of the drum inlet passage, that is, a sectional area of the connection duct 27 is illustrated. FIG. 6 is a temperature graph showing heater control based on a single (invariable) upper/lower limit temperature.

The inventor of the present invention performs experiments which measure temperatures of many points as shown in FIG. 5 to measure an overheat degree on the drum inlet passage in the heated-air drying. Although not shown in the drawings, the temperature at an upper portion of the door glass is measured and the result of the measurement is shown in FIGS. 4 and 6.

Figure 6:
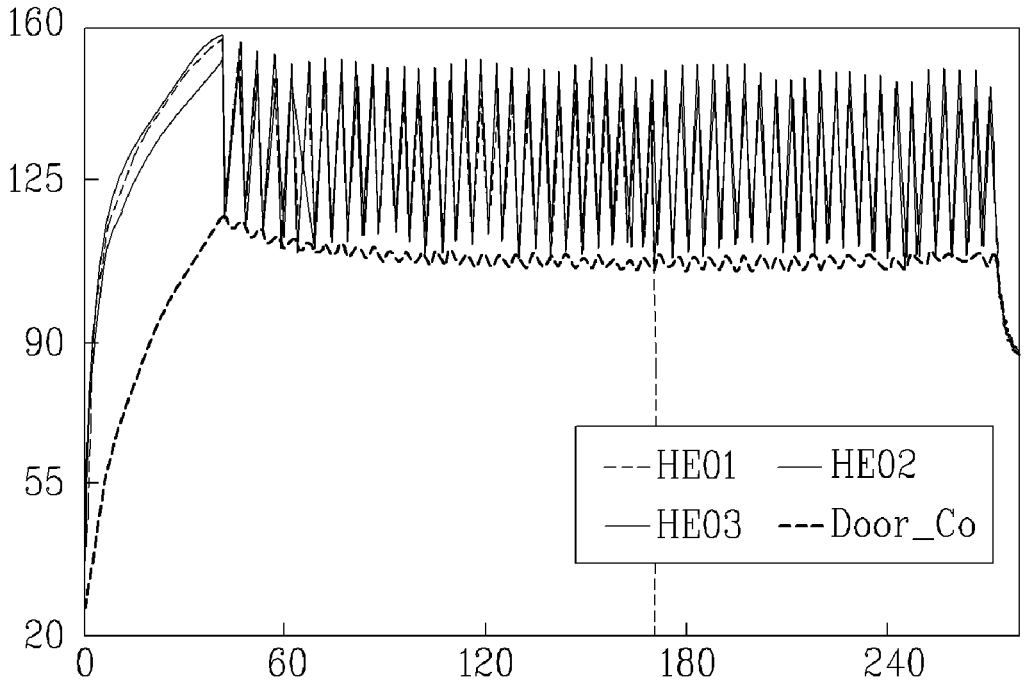
FIG. 6 is a temperature graph according to the control of the heater based on a single (or invariable) upper limit/lower limit temperature.

First of al, FIG. 6 shows temperature change in a state of setting T3 and Tc to be fixed in the heated-air drying. As shown in FIG. 6, the temperature is increasing up to the upper limit of 160° C. on the drum inlet passage. In other words, when the sensed temperature reaches T3, the heater is turned off for the first time and it is shown that overheating is generated at a specific point on the drum inlet passage at this time.

It is shown that more overheating is generated at points (HE01 to HE05, TM_HE) from right to left direction. This can be expected from the differentiated air velocity or amount at the points because of the shape of the fan or the structure of the dry duct.

Also, as shown in FIG. 6, the temperature at the door glass is increased up to the upper limit of 120° C. As a result, it can be expected that overheating is generated at the drum inlet passage including the door glass in the heated-air drying, especially, in the initial drying of the heated-air drying.

However, when The heater is controlled according to T1 lower than T3 or T1 and T2 in the initial drying of the heated-air drying, the upper limit temperature on the drum inlet passage may be lowered approximately to 130° C. This shows that overheating on the drum inlet passage can be prevented effectively without varying the optimal T3/Tc in the intermediate drying in which drying is performed most actively. In other words, overheating may be prevented very effectively even with maintaining drying efficiency as it is and even without increasing the drying time.

Figure 4:
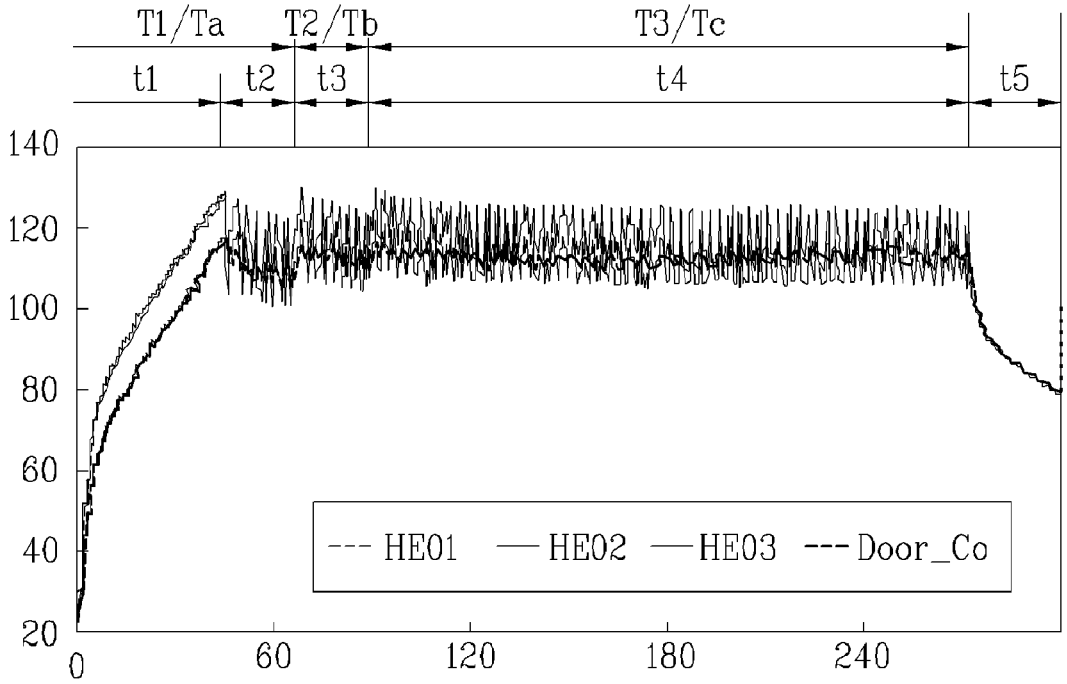
FIG. 4 is a graph illustrating a control method of a heater according to an embodiment.

Especially, it is shown that the upper limit temperature at the door glass is lowered approximately to 115° C. as shown in FIG. 4.

Through this process, heat shock of the door glass may be reduced and a more stable washing machine may be provided. Also, the drying may be performed more efficiently without wasting energy.

As follows, a method of determining a drying degree in case the washing machine having the above structure performs drying. The process of performing the drying may use the heater control method according to the present invention which can prevent overheating as described above or a similar control method to the control of the conventional drying machine. Any of the two methods can be used.

A temperature sensor (not shown) may be provided in the tub 100 of the washing machine to sense the temperature of the tub 100. The temperature sensor senses the temperature of the tub 100 and the sensed temperature is used for various controls of washing operations and drying operations. Such the temperature sensor may sense the temperature of a surface of the tub 100. Here, the surface of the tub 100 of which the temperature is sensed by the temperature sensor may be an inner surface or an outer surface of the tub 100. Also, the temperature sensor may sense the temperature of the heated-air that is circulated via the dry duct 20. Such the temperature sensor may transfer a temperature signal to the controller (not shown). As follows will be described in detail a method of determining a drying degree based on the temperature of the surface of the tub that is sensed by the temperature sensor.

In the meanwhile, the controller controls an overall operation of the washing machine and it operates the washing machine according to settings of the washing machine. The embodiment of the present invention is relating to the drying process of laundry. As a result, descriptions of washing, rinsing and dry-spinning processes will be omitted because they are not related to the drying process. Additionally, the controller senses the signal of the temperature sensor and it controls the motor, a drying module (the heater, the fan and the like) and a display panel, to determine the end of the drying for the laundry supposed to dry via the entire drying process.

The conventional dryer or the conventional washing machine having the drying function may sense the amount of laundry which will be dried as the drying operation starts. At this time, the amount of the laundry may be calculated by using an auxiliary load sensor or using the load applied to the motor rotating the drum 300. In other words, when the load of the motor, the amount of the load applied to the motor may be sensed differently according to the amount of the laundry which will be dried. The amount of the laundry may be sensed by using the amount of the load applied to the motor accordingly.

Figure 7:
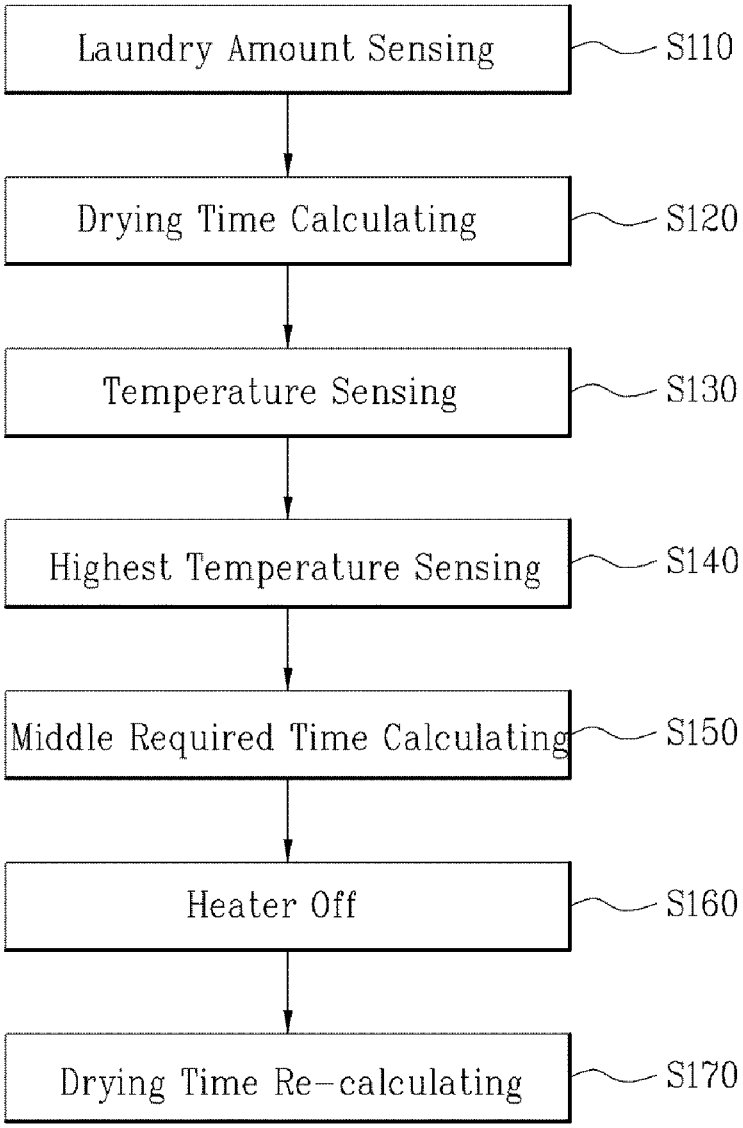
FIG. 7 is a flow chart illustrating a method of determining an end of drying according to an embodiment.

Hence, the controller may calculate the time taken to perform the drying based on the amount of the laundry which will be dried. The time used for drying the laundry may be calculated based on a preset table. In other words, the controller selects a drying time by extracting a drying time corresponding to the sensed amount of the laundry from the preset table. After that, the controller may display the selected drying time on a display part. However, the drying time set based on the amount of the laundry determined according to this method may be applied uniformly. Because of that, sufficient drying fails to be performed in some cases or drying is performed too much. For example, the amount of the laundry includes the weight of the laundry and the weight of the moisture. Because of that, a smaller amount or a larger amount of the laundry may be possessed even by the same quantities of the laundry. This means that a smaller amount or a larger amount of the moisture may be possessed. Even when the drying time is set based on the amount of the laundry uniformly, a drying degree may be variable according to the amount of the moisture contained in the laundry. As a result, a control method of achieving a desired drying degree by performing additional drying in consideration of a drying degree or the required drying time will be described as follows. FIG. 7 is a flow chart illustrating the control method.

In reference to FIG. 7, a control method according to an embodiment may sense the amount of laundry (hereinafter, referenced to as "the laundry amount" before performing a drying process (S110). The laundry amount may be defined to include the amount of laundry which will be dried and the amount of the moisture contained in the laundry. A method of sensing the laundry amount is similar to the method mentioned above and the method is well known knowledge in the air to which the present invention pertains. Detailed description of the method will be omitted accordingly.

After sensing the laundry amount, the controller may calculate a drying time corresponding to the sensed laundry amount (S120), which is similar to a conventional method. The controller calculates the drying time by extracting the drying time corresponding to the sensed laundry amount from a preset table.

Hence, drying is performed. A method of performing the drying may be the method described above according to the present invention, that is, the method which can prevent overheating as mentioned in reference to FIG. 4 or a similar one to the drying performed in the conventional dryer. Such the drying process has been described above and repeated description will be omitted accordingly. During the drying process, the controller senses the temperature of the surface of the tub by using the temperature sensor provided in the tub 100 constantly or repeatedly (S130). This is because it is possible to determine a drying degree of the laundry based on the temperature of the surface (hereinafter, referenced to as "the surface temperature" of the tub.

Figure 10:
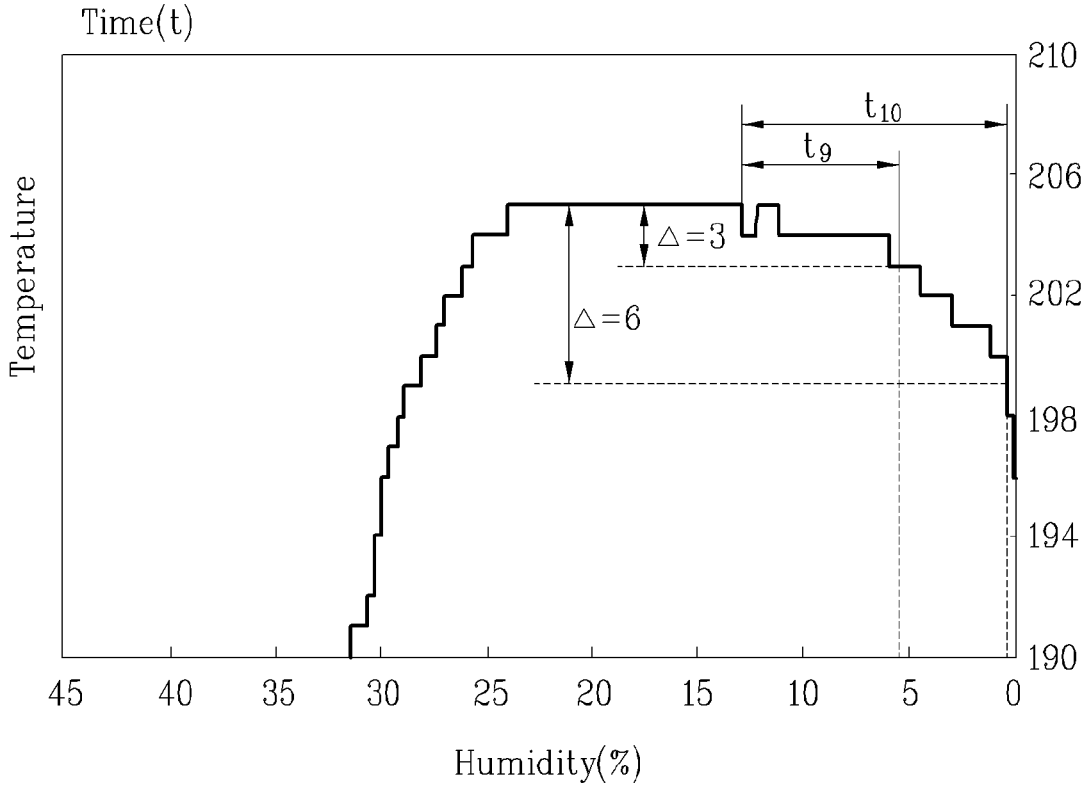

For example, FIGS. 8, 9 and 10 are graphs showing change of surface temperatures of the tub during the drying process of predetermined laundry. A horizontal axis shown in each of the graphs may refer to time passage together with humidity change and a vertical axis may refer to change of the surface temperature of the tub.

According to each of the graphs, as the time passes along the horizontal axis from left to right, a percentage of humidity contained in the laundry, in other words, a moisture content of the laundry may is decreasing. As the drying is performed, the moisture is removed from the laundry and it is likely that the moisture content is decreasing. In the meanwhile, according to the surface temperature of the tub as the time passes, the surface temperature of the tub may be increasing constantly as the drying is performed after it starts. The surface temperature of the sub reaches"the upper limit temperature" without increasing any further and it decreases after that.

Dry heated-air is constantly supplied to the inside of the tub in the initial drying in which the drying starts to perform and in the intermediate drying in which the drying is performed actively. The moisture may be removed from the laundry by the supply of the dry heated-air. The removed moisture receives the high temperature heat from the heated-air and it may be changed into gas, remaining with quite a heat. The gaseous moisture may transfer the heat to the tub inside the tub and the surface temperature of the tub may be increasing gradually. In other words, the surface temperature of the tub may increase in the initial drying and the intermediate drying. This is because the heat is transferred by the gaseous moisture removed from the laundry. Here, the increase of the tub surface temperature may be generated by the heated-air and a main reason of the surface temperature increase may be the heat transferred from the moisture to the tub. Because of that, the surface temperature of the tub reaches the highest temperature in the intermediate drying in which the drying is performed most actively.

However, when the drying is performed after the intermediate drying passes, the amount of the moisture removed from the laundry may be decreasing. As a result, the surface temperature of the tub may be decreasing constantly after the intermediate drying and this may mean that the amount of the moisture removed from the laundry is decreasing because the drying is performed too much.

Because of that, a control method which will be described as follows may determine a drying degree by sensing a decrease degree of the temperature after the surface temperature of the tub reaches the highest temperature.

The controller may sense the highest temperature of the surface temperature of the tub by temperature sensing (S140). In other words, the controller may sense change of the temperature by using the temperature sensor and it may sense the highest temperature of the surface temperature of the tub. The highest temperature of the tub surface may be a temperature at which the surface temperature of the tub is maintained for a predetermined time period, for example, 2 minutes or more, without increasing any further. Alternatively, when the surface temperature of the tub decreases at a predetermined temperature, the controller determines a temperature just prior to the predetermined temperature making the surface temperature decrease as the highest temperature.

Hence, the controller may calculate"a middle required time" (S150). Here, the middle required time may be defined as a time period from the time when the surface temperature of the tub starts to decrease from the highest temperature until the surface temperature of the tub reaches a preset temperature decrease value (Δ). For example, a period referenced to as t6 in the graph of FIG. 8 may be defined as the middle required time. Here, the preset temperature decrease value (Δ) may be a preset default value, for example, 3. In other words, the controller may set the time period (t6 shown in FIG. 8) from the time when the surface temperature of the tub decreases from the highest temperature until by the preset temperature decrease value (Δ) of 3 degrees as the middle required time.

Here, the reason why the middle required time is calculated is as follows. The drying time may be variable according to the amount of the laundry which will be dried, more specifically, the amount of the moisture contained in the laundry in the drying. As a result, when the laundry amount is equal to a preset value or less (or when the moisture amount contained in the laundry is equal to a preset value or less), the drying time may decrease. When the laundry amount is equal to a preset value or more (or when the moisture amount contained in the laundry is equal to a preset value or more), the drying time may increase. This will be described in relation to the control method according to the present invention as follows. When the laundry amount is equal to a preset value or less (or when the moisture amount contained in the laundry is equal to a preset value or less), the middle required time may decrease. When the laundry amount is equal to a preset value or more (or when the moisture amount contained in the laundry is equal to a preset value or more), the middle required time may increase. The middle required time may be determined based on the surface temperature of the tub and it may be included in the total drying time. Because of that, the middle required time may be changed in proportion to change of the total drying time.

As a result, a drying degree of the laundry is determined based on the calculated middle required time to determine whether to turn off the heater. For example, FIG. 8 is a graph illustrating change of the surface temperature of the tub in case the laundry amount is relatively small (for example, 1 kg or less). The middle required time shown in FIG. 8 may be calculated may be calculated to be t6 as mentioned above.

In the meanwhile, the controller may compare the middle required time with a preset reference time. If the middle required time is less than the reference time, it is determined that drying is performed sufficiently and the heater is controlled to be off (S160). If the middle required time is more than the reference time, it is determined that the drying is performed insufficiently and a temperature decrease value (Δ) is re-set, to re-calculate the middle required time.

In other words, when the time required for the surface temperature of the tub to decrease to the preset temperature decrease value (Δ) from the highest temperature is shorter than the reference time, it is determined that the moisture amount contained in the laundry is relatively small and it is determined that the drying is performed sufficiently.

In contrast, when the time required for the surface temperature of the tub to decrease to the preset temperature decrease value (Δ) from the highest temperature is longer than the reference time, it is determined that the moisture amount contained in the laundry is relatively large, only to determine that the drying is performed insufficiently. Because of that, the temperature decrease value (Δ) may be re-set. In this case, the temperature decrease value (Δ) may be set variously according to the relation between the middle required time and the reference time. In other words, the reference time is preset variously and the temperature decrease value (Δ) may be set according to the reference time. For example, the reference time includes a first reference time and a second reference time. The first reference time may be set to be 90 minutes and the second reference time may be set to be 240 minutes.

In this case, when the middle required time is shorter than the first reference time based on the result of comparison between the two, the heater may be off at the end of the middle required time. When the middle required time is longer than the first reference time and shorter than the second reference time, the controller may change the temperature decrease value (Δ) into a first changed value having an absolute value that is larger than the default value, for example, "4". By extension, when the middle required time is longer than the second reference, the controller may change the temperature decrease value (Δ) into a second changed value having an absolute value that is larger than the first changed value, for example, "6". The fact that the middle required time using the default temperature decrease value (Δ) is longer than the reference time means that it takes a relatively long time to remove the moisture because the moisture amount contained in the laundry is much. As a result, the absolute value of the temperature decrease value (Δ) is increased to perform the drying sufficiently.

For example, once it is determined that the middle required time (t6) is smaller than the first reference time after the middle required time is compared with the first reference time in FIG. 8, the controller may control the heater to be off (S160). When the time taken for the surface temperature of the tub to decrease to the preset temperature decrease value (Δ) from the highest temperature is smaller than the first reference time, it is determined that the moisture amount contained in the laundry is relatively small and that the drying is performed sufficiently.

In the meanwhile, FIG. 9 is a graph illustrating change of the surface temperature of the tub according to a different drying degree from the drying degree of FIG. 8. Even in this case, the controller may calculate a middle required time which is referenced to as "t7" and the controller may compare the middle required time (t7) with a first reference time (90 minutes). When the middle required time (t7) is larger than the first reference time, the controller may re-compare the middle required time with a second reference time (for example, 240 minutes). In this case, when the middle required time (t7) is larger than the first reference time and smaller than the second reference time, the controller may determine that much moisture still remains and it may re-set the temperature decrease value (Δ) to be a first changed value, for example, 4 from a default value. The controller may re-calculate the middle required time based on the changed temperature decrease value and the changed middle required time is referenced to as t8 in FIG. 9. Hence, the controller may determine that the moisture amount contained in the laundry is reduced at an ending point of the middle required time (t8), in other words, at the time period when the surface temperature reaches the changed temperature decrease value (Δ), and then the controller may control the heater to be off. Substantially, FIG. 9 is a graph illustrating change of the surface temperature of the tub in case the laundry amount is a middle level (for example, 4 kg). The graph of FIG. 9 is corresponding to the more laundry amount, compared with the graph of FIG. 8 and then the middle required time may be longer in FIG. 9.

In the meanwhile, FIG. 10 is a graph illustrating change of the surface temperature of the tub in case the laundry amount is a different amount level, compared with FIGS. 8 and 9. Even in this case, the controller may calculate a middle required time and the middle required time may be referenced to as "t9". The controller may compare the middle required time (t9) with a first reference time (90 minutes). When the middle required time (t9) is larger than the first reference time, the middle required time may be re-compared with a second reference time (for example, 240 minutes). In this case, when the middle required time (t9) is larger than the first reference time and the second reference time, the controller may determine that the much moisture amount remains and it may re-set a temperature decrease value (Δ) to be a second changed value, for example, "6" from a default value. In this case, the controller may re-calculate the middle required time based on the changed temperature decrease value (Δ) and the changed middle required time is referenced to as "t10" in FIG. 10. Hence, the controller may determine that the moisture amount contained in the laundry is reduced at the time when the surface temperature reaches the changed temperature decrease value (Δ) and that the drying is performed sufficiently, to control the heater to be off based on the result of the determination. Substantially, FIG. 10 is a graph illustrating change of the surface temperature of the tub in case the laundry amount is relatively large (for example, 7 kg or more). The graph of FIG. 10 is corresponding to the more laundry amount, compared with the graphs of FIGS. 8 and 9. Because of that, the middle required time may be longer.

In the meanwhile, once determining that the drying is complete, the controller may end the drying process by shutting off the electric power supplied to the heater of the dry duct 20. Here, the controller may shut off the power supplied to the heater of the dry duct 20 additionally but it may keep the electric power supplied to the fan of the dry duct 20. This is because the heated-air remaining in the dry duct has to be supplied to improve drying efficiency. By extension, when the air remaining in the dry duct is cooled to be a normal temperature, the laundry dried by the heated-air may be cooled and the drying process may be completed simultaneously by supplying a normal temperature air. The supply time of the air supplied to the laundry (the time in which only the fan is driven with the heater being off) may be set differently based on the laundry amount.

Finally, the controller may perform a drying time re-calculating step (S170). In other words, the controller may calculate the time period from the time of the heater being on until the end of the middle required time, as a changed drying time. When the middle required time is changed in the middle of the time as described in reference to FIGS. 8 to 10, the controller may calculate the time period until the ending point of the changed middle required time as the drying time. After that, the controller may display the changed drying time via the display part. As a result, the user may recognize a first drying time based on the laundry amount according to this embodiment as the drying of the laundry is performed and he or she may recognize the required time of actual drying from temperature change of the tub as the drying is performed.

As follows, a method of determining a drying degree in a washing machine including the air-cooled type condensation means will be described.

Figure 11:
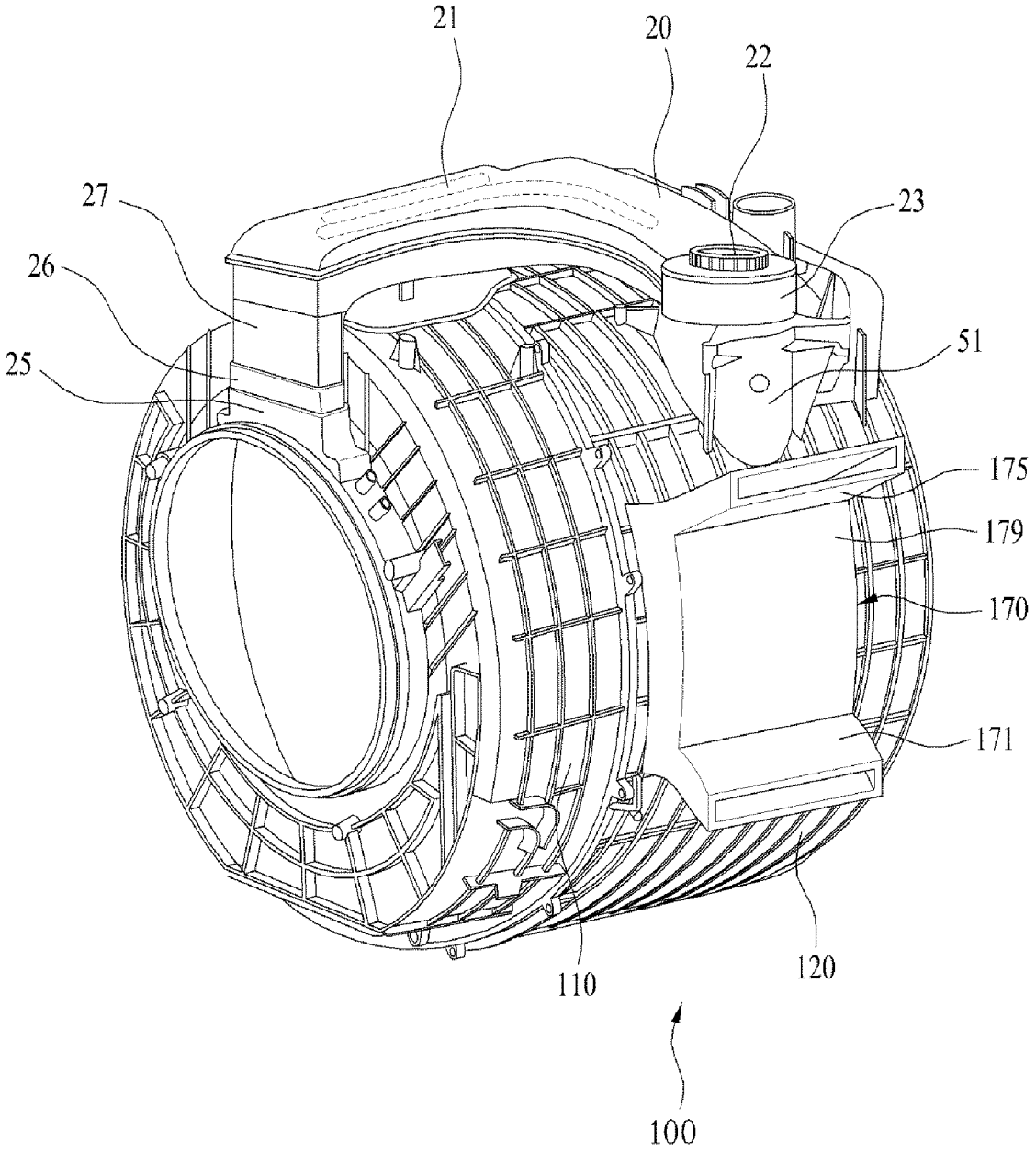
FIG. 11 is a perspective view illustrating a tub, a drum a dry duct and condensation means provided in a washing machine including air-cooled type condensation means according to an embodiment.
Figure 12:
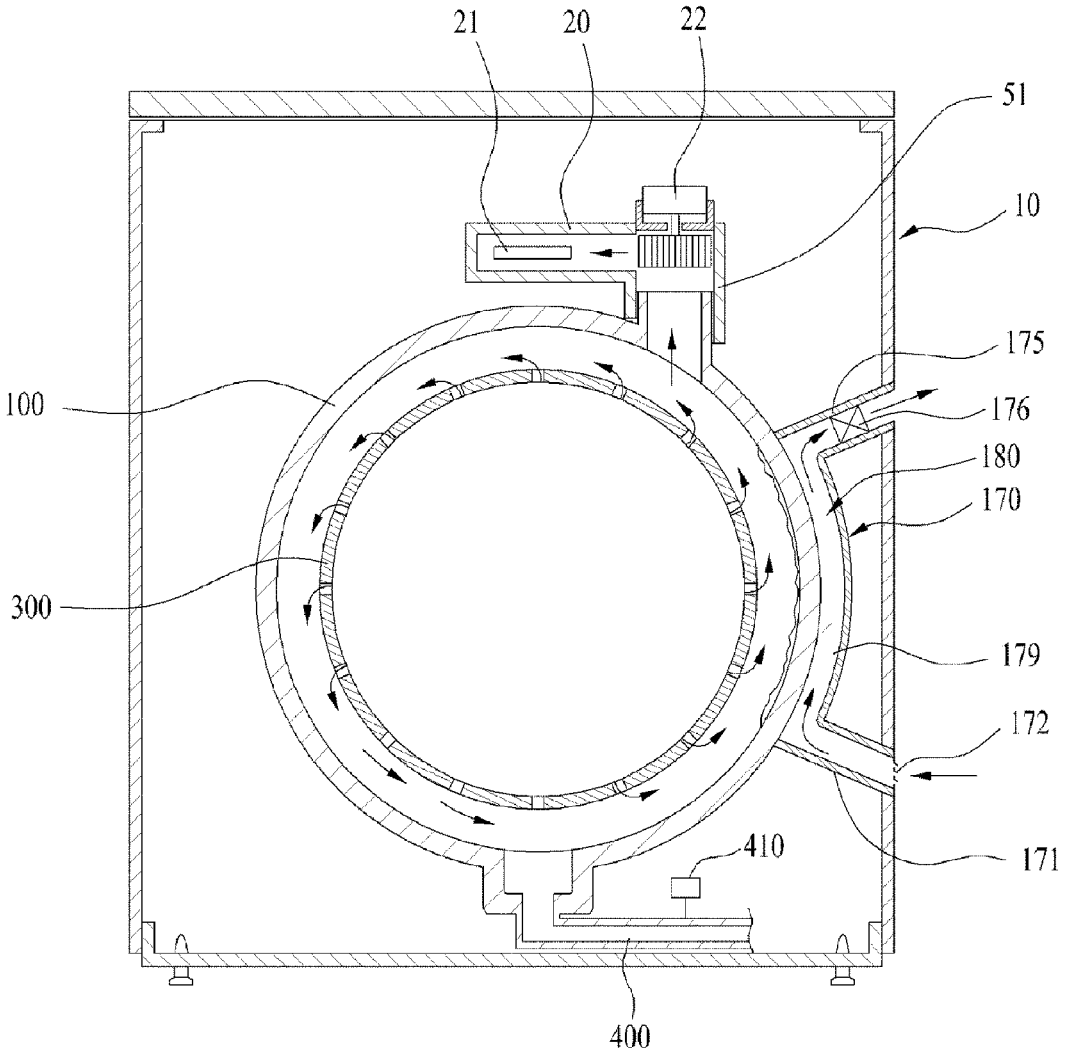
FIG. 12 is a sectional view illustrating the tub shown in FIG. 11 which is mounted in a cabinet.

FIG. 11 is a perspective view illustrating a tub provided in a washing machine having a drying function according to anther embodiment of the present invention. FIG. 12 is a sectional view illustrating the tub shown in FIG. 11 which is provided in a cabinet 10.

In reference to FIGS. 11 and 12, the washing machine having the drying function according to another embodiment of the present invention may include air-cooled type condensation means 170 mounted on an outer circumferential surface of the tub 100 to cool an outer wall of the tub 100 by suck external air of a cabinet 10 to make an inner surface of the tub 100 employed as a condensation surface.

Such the air-cooled type condensation means 170 includes a suction passage 171 in communication with a side of the cabinet 10 to suck the external air of the cabinet 10 therein, an exhaustion passage 175 formed in another side of the cabinet 10 to exhaust the external air heat-exchanged with an outer circumferential surface of the tub 100 outside the cabinet, and a condensation passage 179 formed in the outer circumferential surface of the tub 100 to allow the external air sucked via the suction passage 171 to be exhausted via the exhaustion passage 175 after heat-exchanged while flowing along the outer circumferential surface of the tub 100.

Here, a ventilation fan 176 is installed on the exhaustion passage 175 to increase the amount of air and to improve heat exchange efficiency via forced convection. A filter (not shown) and a grill 172 may be installed in an opening of the suction passage 171 to prevent foreign matters such as dust from being drawn into the suction passage 171.

As the ventilation fan 176 of the air-cooled type condensation means 170 is operated while the drying process is performed, external air of the cabinet 10 may be drawn into the suction passage 171 forcibly. The air sucked into the suction passage 171 is exhausted outside the cabinet 10 from the exhaustion passage 175 via the condensation passage 179.

At this time, the external air sucked into the suction passage 171 takes the heat out of the outer wall of the tub 100, while flowing through the condensation passage 179 from the suction passage 171, to be exhausted outside the cabinet 10.

In other words, the external air sucked into the suction passage 171 may cool an inner wall of tub 100 through heat transfer with the outer wall of the tub 100, such that condensate may be generated and that the generated condensate may be drained via a drainage hole.

In the meanwhile, a water level sensor 410 configured to sense the amount of the wash water stored in the tub 100 may be provided in a drainage line 400 the wash water and the condensate are drained along. When the drying is performed in case the air-cooled type condensation means is provided, the water level sensor may sense the amount of the condensate generated in the drying of the laundry.

Figure 13:
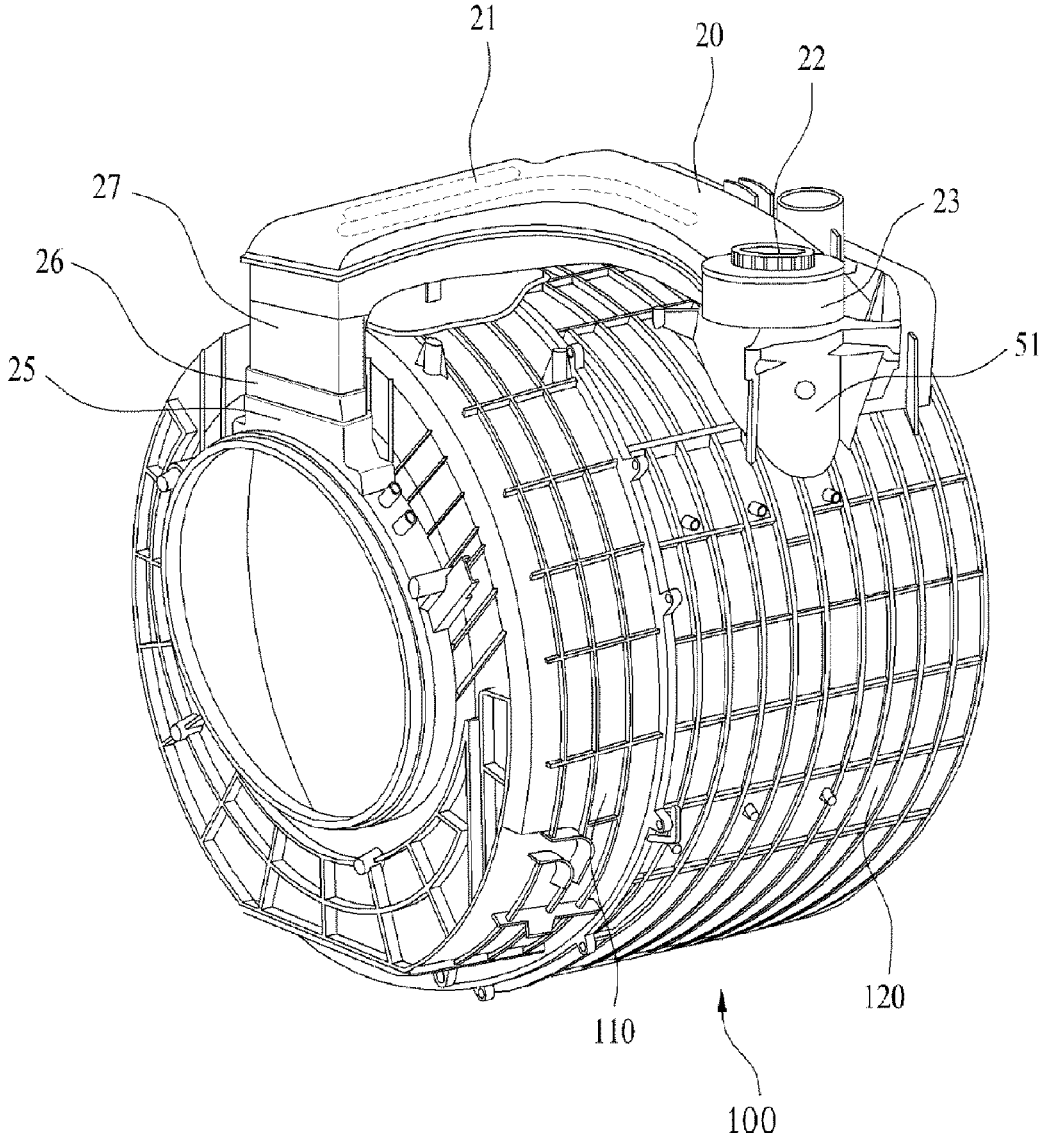
FIG. 13 is a perspective view illustrating a tub, a drum a dry duct and condensation means provided in a washing machine including air-cooled type condensation means according to another embodiment.
Figure 14:
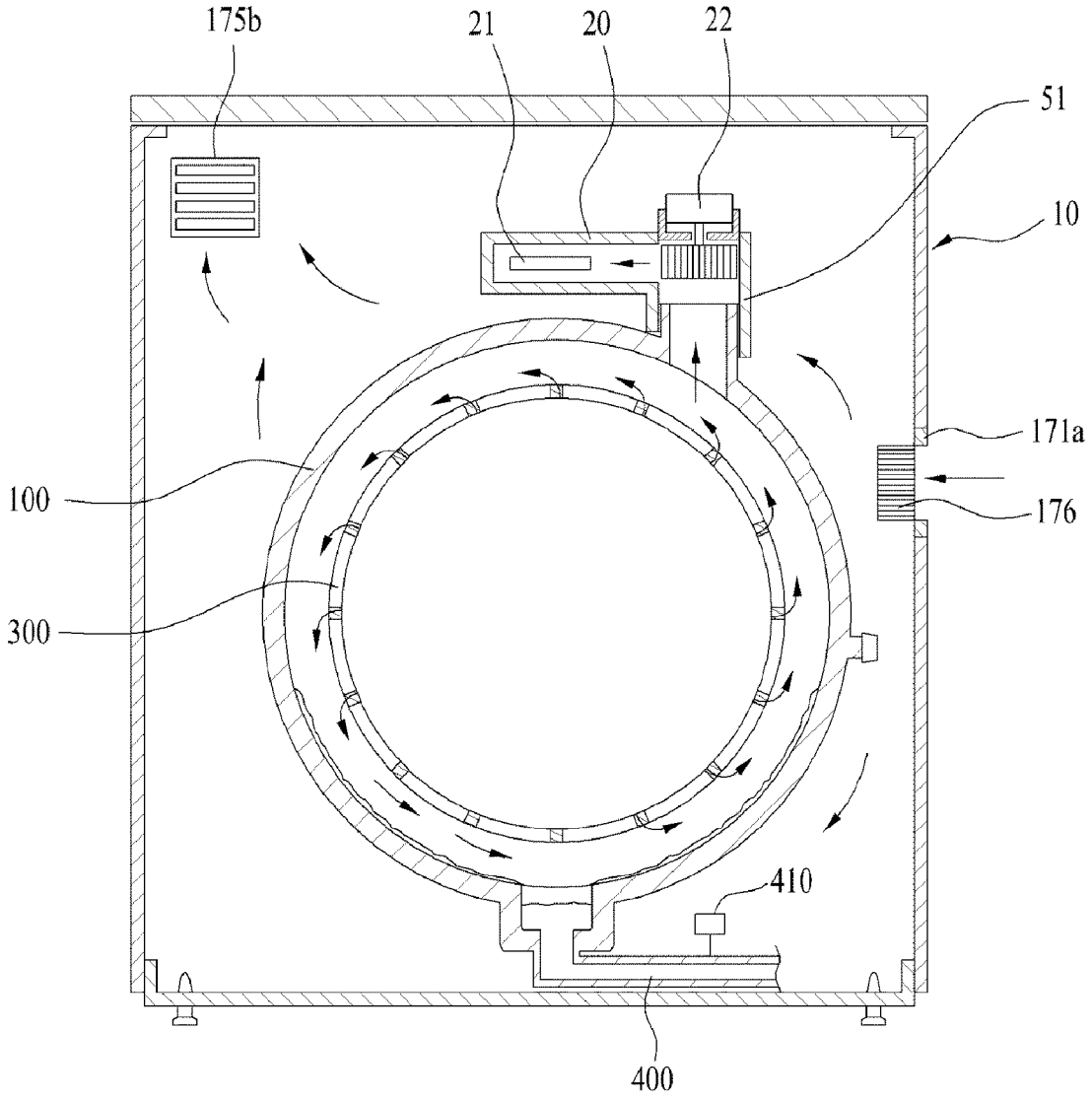
FIG. 14 is a sectional view illustrating the tub shown in FIG. 13 which is mounted in a cabinet.

FIG. 13 is a perspective view illustrating a tub provided in a washing machine having a drying function according to a further embodiment of the present invention. FIG. 14 is a sectional view illustrating the tub of FIG. 13 in a state of mounted in a cabinet 10.

In reference to FIGS. 13 and 14, air-cooled type condensation means may include a suction hole 171*a* formed in a side of a cabinet 10 to suck external air into the cabinet 10, an exhaustion hole 175*b* formed in the other opposite side of the cabinet to exhaust the external air heat-exchanged with a circumferential surface of the tub outside the cabinet 10. here, it is shown that the suction hole 171*a* may be one of the right and left side surfaces of the cabinet 10 and that the exhaustion hole 175*b* may be formed in a rear surface of the cabinet 10, and the locations of the suction hole 171*a* and the exhaustion hole 175*b* are not limited thereto.

Also, a ventilation fan 176 is installed in front of the suction hole 171*a* to improve the air amount and to cool an outer circumferential surface of the tub 100 by using forced convection.

Alternatively, a ventilation fan may be installed in front of the exhaustion hole 175*b*. Here, the ventilation fan 176 is installed only in front of the suction hole 171*a* according to this embodiment.

Figure 15:
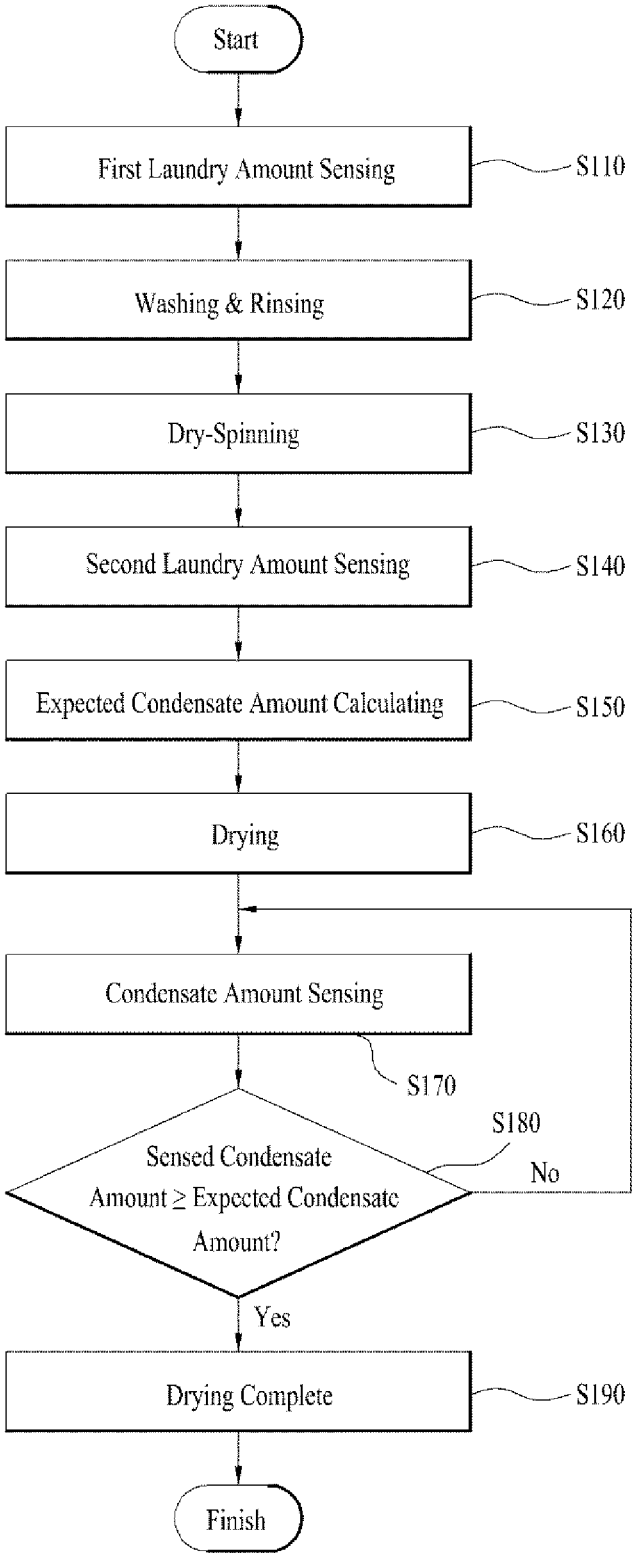
FIG. 15 is a flow chart illustrating a method of determining an end of drying.

In reference to FIG. 15, when the drying process is performed, the external air sucked via the suction hole 171*a* may heat-exchange with an entire area of the circumferential surface of the tub 100, while passing the entire area of the cabinet inside, only to condense the air which has dried the laundry. After that, condensate may be generated on an overall inner circumferential surface of the tub 100 and the generated condensate may be drained via the drainage hole of the tub 100.

In the meanwhile, a water level sensor 410 may be provided in a drainage line 400 the wash water and the condensate are drained along, to sense the amount of the wash water stored in the tub 100, which is identical to the description mentioned above.

As follows, a method of determining drying completion of the laundry according to each of the embodiments mentioned above will be described in reference to FIG. 15. Before making description, the present invention is relating to a method of determining drying completion of laundry. Because of that, detailed description having no relation with the subject matter of the present invention will be omitted.

In reference to FIG. 15, the washing machine may sense the first amount of laundry loaded therein to wash as a washing process starts (S110). The first amount of the laundry may be sensed before water is supplied to the drum of the washing machine or the first amount of the laundry may be sensed before a washing cycle of the washing machine is performed. The measuring of the laundry amount is a key element used for calculating the amount of wash water and the amount of detergent required to perform washing. Commonly, the measurement of the laundry amount may be performed in all types of washing machines. As a result, a method of measuring the laundry amount will be omitted in the present invention.

In the meanwhile, as the first amount of the laundry is sensed, a amount of wash water and detergent determined based on the amount of the laundry may be supplied to perform washing and rinsing (S120). Once the washing is complete, the wash water may be drained and dry-spinning starts (S130).

Once the washing and dry-spinning of the laundry is complete, the second amount of the laundry having dry-spun may be sensed (S140). The second amount of the laundry may be sensed after water is supplied to the drum of the washing machine or the second amount of the laundry sensing step may be sensed before a drying cycle of the washing machine is performed. The second amount of the laundry sensed at this time may include the weight of the laundry itself and the amount of the wash water contained in the laundry (commonly, the wash water contained in the laundry may not be removed in the spinning completely).

Hence, before the drying starts, the expected amount of condensate which will be generated during the drying may be calculated (S150). Here, the expected amount of the condensate may be defined as the amount of the laundry which remains after subtracting the first amount of the laundry from the second amount of the laundry. In other words, the first amount of the laundry is the weight of the laundry before the washing starts, that is, the weight of dry laundry and the second amount of the laundry may be the weight of the wet laundry before the drying starts, that is, the laundry containing the moisture. As a result, when the first amount of the laundry is subtracted from the second amount of the laundry, the amount (or the weight) of the moisture contained in the laundry may be calculated and this calculated value may be defined as the expected amount of the condensate. As a result, when the moisture corresponding to the expected amount of the condensate is removed in the drying process, it may be determined that the drying is complete.

However, the expected amount of the condensate may be adjusted to protect the laundry. For example, if the weight which remains after subtracting the first amount of the laundry from the second amount of the laundry is defined as the expected amount of the condensate as it is, 100% of drying may be performed to the laundry and over-drying might be generated. Because of that, damage on the laundry might be generated. By extension, when calculating the amount of the laundry, it may be difficult to measure the amount of the laundry 100% precisely because of errors of the sensor and it may be difficult to define the weight remaining after subtracting the first laundry amount from the second laundry amount as the expected amount of the condensate as it is. As a result, the controller may define as the expected amount of the condensate a proper rate of the weight remaining after subtracting the first laundry amount from the second laundry amount, for example, from 60% to 100%. The rate may be preset and input to the controller or it may be adjusted by the user selection. Especially, if the user is supposed to iron the laundry after the drying, the rate may be set lower.

Once the expected amount of the condensate is calculated as mentioned above, the drying of the laundry may be performed (S160). In this case, the condensate generated ion the inner circumferential surface of the tub 100 may flow along the inner wall of the tub 100 to be exhausted via a wash water drainage hole provided in a bottom of the tub 100. At this time, the amount of the drained condensate may be measure by the water level sensor 410 provided in the drainage line 400 (S170).

The measured amount of the condensate may be compared with the expected amount of the condensate (S180). Here, when the measured amount of the condensate is smaller than the expected amount of the condensate, it means the drying is not performed sufficiently and the drying may be performed continuously. When the measured amount of the condensate is identical to the expected amount of the condensate, it is determined that the drying is complete and the drying is controlled to be complete (S190).

In the meanwhile, a drying method according to an embodiment of the present invention represents that the drying completion is determined based on the amount of the condensate calculated based on the comparison between the measured amount and the expected amount. However, the amount of the condensate generated during the drying may be measured constantly to determine a point of the drying completion, without calculating the calculating the amount of the condensate.

In other words, the condensate may be generated on the inner wall of the tub 100 as the drying is performed. The generated condensate may flow along the inner wall of the tub into the drainage hole where the wash water is drained. In the meanwhile, the water level sensor 410 maybe provided in the drainage line 400 connected with the drainage hole to sense the amount of the wash water and the water level sensor 410 may measure the amount of the condensate. As a result, the condensate generated during the drying process may be drained via the drainage hole constantly and the water level sensor may measure the condensate constantly. The drying completion may be determined when a point at which the measured amount of the condensate is reduced drastically (in other words, a preset value based on the amount of the laundry as a point of determining drying completion) is reached.

According to the washing machine having the drying function and the drying method as described above, external air may be sued to condense the air having dried the laundry, without using cooling water. Because of that, water usage may be reduced. In addition, the point of the drying completion with respect to the laundry may be determined relatively precisely by using the condensate.

The invention claimed is:

1. A washing machine, comprising:

a cabinet;

a tub provided in the cabinet to hold water therein, the tub having a heated-air inlet located at a front side of the tub and a heated-air outlet located in an upper side of the tub to allow inflow and exhaustion of hot air;

a drum rotatably provided in the tub;

a dry duct connected to the heated-air inlet and the heated-air outlet in fluid communication to provide a passage for the hot air to flow into the tub;

a heater provided in the dry duct to generate hot air;

a fan located between the heated-air outlet and the dry duct;

an air-cooled type condensation device that condenses moisture on at least a predetermined area of an inner circumferential surface of the tub by heat-exchanging external air drawn into the cabinet with at least a predetermined area of an outer circumferential surface of the tub; and a first sensor that senses an amount of condensate generated in the tub.

2. The washing machine as claimed in claim 1, wherein the first sensor is a water level sensor that senses the amount of the condensate stored in the tub.

3. The washing machine as claimed in claim 1, wherein the air-cooled type condensation device comprises:

a suction passage that sucks the external air into the cabinet;

a condensation passage that guides the air toward the predetermined area of the outer circumferential surface of the tub; and an exhaustion passage that exhausts the air that has passed through the condensation passage outside of the cabinet.

4. The washing machine as claimed in claim 3, wherein a ventilation fan that ventilates the air is provided in the exhaustion passage.

5. The washing machine as claimed in claim 1, wherein the air-cooled type condensation device comprises:

a suction hole provided in the cabinet through which the external air is drawn into the cabinet; and an exhaustion hole provided in the cabinet through which the air inside the cabinet is exhausted outside of the cabinet.

6. The washing machine as claimed in claim 5, further comprising:

a ventilation fan provided in at least one of the suction hole or the exhaustion hole.

7. The washing machine as claimed in claim 1, wherein a first end of the dry duct is connected with the heated-air inlet hole that channels air inside the tub to the dry duct, and a second end of the dry duct is connected with the heated-air outlet hole that supplies air into the tub.

8. The washing machine as claimed in claim 7, wherein the heated-air outlet hole is provided in an upper rear portion of the tub and the heated-air inlet hole is provided in an upper front portion of the tub.

9. The washing machine as claimed in claim 8, wherein the heated-air inlet hole is located in front of an opening formed in the drum.

10. The washing machine as claimed in claim 1, further comprising:

a shaft connected with the drum;

a bearing housing that rotatably supports the shaft;

a motor that rotates the shaft; and a suspension connected with the bearing housing, to dampen vibration of the drum.

11. The washing machine as claimed in claim 1, further comprising:

a drive comprising a shaft connected with the drum, a bearing housing that rotatably supports the shaft, and a motor that rotates the shaft; and a seal that seals a rear portion of the tub to prevent water from leaking to the drive from the tub, wherein the seal allows the drive to move relatively with respect to the tub.

12. The washing machine as claimed in claim 1, further comprising:

a suspension that supports the drum, wherein the tub is supported by the suspension more rigidly than the drum is supported by the suspension.

13. A method for controlling a washing machine as claimed in claim 1, the method comprising:

sensing via a second sensor a first amount of laundry, wherein the first amount is sensed before water is supplied to the drum of the washing machine;

sensing via the second sensor a second amount of the laundry, wherein the second amount is sensed before a drying cycle of the washing machine is performed;

calculating via a controller in communication with the second sensor an expected amount of condensate based on the sensed first and second amounts of the laundry, wherein the calculating the expected amount of the condensate comprises calculating the expected amount of the condensate by subtracting the first amount of laundry from the second amount of laundry;

sensing via the first sensor the amount of condensate generated while drying of the laundry is performed; and determining via the controller a drying completion point by comparing the sensed amount of the condensate with the expected amount of the condensate.

14. The method as claimed in claim 13, wherein the first amount of the laundry is sensed via the second sensor before a washing or rinsing cycle of the washing machine is performed.

15. The method as claimed in claim 13, wherein the second amount of the laundry is sensed via the second sensor after a rinsing or dry-spinning cycle of the washing machine is performed.

16. The method as claimed in claim 13, wherein the calculating the expected amount of the condensate comprises setting a predetermined percentage of a value remaining after subtracting the first amount of the laundry from the second amount of the laundry as the expected amount of the condensate.

17. The method as claimed in claim 13, wherein the determining the drying completion point comprises turning off a heater of the washing machine, when the sensed amount of the condensate is equal to the expected amount of the condensate or more.

18. The method as claimed in claim 17, further comprising driving the fan for a predetermined time period after the heater is off.

* * * * *